US009441571B2

(12) United States Patent
Petersen et al.

(10) Patent No.: US 9,441,571 B2
(45) Date of Patent: Sep. 13, 2016

(54) SELF-TUNING ELECTRONIC FUEL INJECTION SYSTEM

(75) Inventors: Todd Alan Petersen, Scottsdale, AZ (US); Michael Anthony Wittkopf, El Paso, TX (US)

(73) Assignee: MSD LLC, Bowling Green, KY (US)

( * ) Notice: Subject to any disclaimer, the term of this patent is extended or adjusted under 35 U.S.C. 154(b) by 836 days.

(21) Appl. No.: 13/611,539

(22) Filed: Sep. 12, 2012

(65) Prior Publication Data

US 2014/0074377 A1 Mar. 13, 2014

(51) Int. Cl.

| | |
|---|---|
| ***F02D 41/14*** | (2006.01) |
| ***F02D 41/32*** | (2006.01) |
| ***F02D 41/24*** | (2006.01) |
| *F02D 41/28* | (2006.01) |

(52) U.S. Cl.

CPC ..... *F02D 41/32* (2013.01); *F02D 41/2445* (2013.01); *F02D 41/2451* (2013.01); *F02D 41/2477* (2013.01); *F02D 41/2454* (2013.01); *F02D 2041/286* (2013.01); *F02D 2200/0402* (2013.01); *F02D 2200/0406* (2013.01); *F02D 2200/0411* (2013.01)

(58) Field of Classification Search

CPC .... F02M 51/00; F02M 51/005; F02D 41/00; F02D 41/04; F02D 41/14; F02D 41/1401; F02D 41/1477; F02D 41/32; F02D 41/2445; F02D 41/2451; F02D 41/2477; F02D 41/2454; F02D 2041/286; F02D 2200/0402; F02D 2200/0406; F02D 2200/0411

USPC ..... 701/103, 104, 106; 123/406.33

See application file for complete search history.

(56) References Cited

U.S. PATENT DOCUMENTS

| | | | | |
|---|---|---|---|---|
| 7,899,603 | B2 * | 3/2011 | Yamamoto et al. | 701/104 |
| 8,055,433 | B2 * | 11/2011 | Omuro et al. | 701/104 |
| 2003/0150428 | A1 * | 8/2003 | Hozuki | 123/486 |
| 2006/0074595 | A1 * | 4/2006 | Yuan et al. | 702/182 |

* cited by examiner

*Primary Examiner* — Hai Huynh
*Assistant Examiner* — Raza Najmuddin
(74) *Attorney, Agent, or Firm* — Standley Law Group LLP

(57) ABSTRACT

A self-tuning fuel injection system and method having a first long-term fuel trim correction algorithm to selectively replace an operating zone within a volumetric efficiency look-up table based with a proposed correction only if mathematical comparisons with a surrounding determinative zone reveal that the correction will not result in an abrupt discontinuity. Mathematical comparison models may include absolute values of the differences or percent differences of each proposed cell and its neighbors, the difference of each proposed cell and the mean of its eight neighbors, and standard deviation of each proposed cell and its neighbors. A second repair algorithm repairs values surrounding an operating zone that have such a dissimilar magnitude as to cause poor engine performance using linear interpolation, for example. According to the invention, either the correction or the repair algorithm, or both, are executed in series or in parallel.

16 Claims, 13 Drawing Sheets

126

200 kPa

| RPM | 10 | 15 | 20 | 25 | 30 | 35 | 40 | 45 | 50 | 55 | 60 | 65 | 70 | 75 | 80 | 85 | 90 | 95 | 100 | 105 | 120 | 140 | 160 | 180 | 199 |
|---|---|---|---|---|---|---|---|---|---|---|---|---|---|---|---|---|---|---|---|---|---|---|---|---|---|
| 200 | 41.0 | 41.0 | 42.0 | 42.0 | 42.0 | 42.0 | 42.0 | 42.0 | 42.0 | 42.0 | 43.0 | 44.0 | 45.6 | 49.3 | 51.7 | 52.0 | 52.0 | 52.0 | 53.0 | 54.0 | 56.0 | 61.1 | 62.1 | 64.0 | 70.0 |
| 400 | 41.0 | 41.0 | 42.0 | 42.0 | 42.0 | 42.0 | 42.0 | 42.0 | 42.0 | 42.0 | 43.0 | 44.0 | 45.6 | 50.2 | 51.7 | 58.2 | 59.2 | 59.2 | 61.1 | 61.1 | 62.1 | 62.1 | 63.1 | 65.0 | 70.0 |
| 600 | 41.0 | 41.6 | 42.0 | 42.0 | 42.0 | 42.0 | 42.0 | 42.0 | 42.0 | 42.0 | 43.0 | 44.0 | 46.5 | 48.4 | 51.7 | 59.4 | 59.9 | 63.1 | 63.1 | 64.0 | 64.0 | 65.0 | 66.9 | 70.0 | 70.0 |
| 800 | 41.0 | 41.6 | 42.0 | 42.0 | 42.5 | 42.5 | 42.5 | 42.5 | 42.5 | 43.0 | 44.0 | 44.0 | 47.5 | 50.2 | 53.6 | 59.3 | 59.8 | 63.1 | 63.1 | 64.0 | 65.0 | 66.0 | 66.9 | 70.0 | 70.0 |
| 1000 | 41.6 | 41.6 | 42.0 | 43.0 | 43.0 | 43.0 | 43.4 | 43.4 | 43.4 | 43.4 | 43.4 | 44.3 | 49.0 | 48.8 | 55.1 | 61.1 | 60.9 | 63.0 | 63.1 | 64.0 | 65.0 | 66.0 | 67.9 | 70.0 | 70.0 |
| 1200 | 41.6 | 41.6 | 42.0 | 43.0 | 43.0 | 43.0 | 43.7 | 44.0 | 44.4 | 46.0 | 46.0 | 46.9 | 49.3 | 51.1 | 55.3 | 61.2 | 60.4 | 62.7 | 63.1 | 63.1 | 66.0 | 67.9 | 67.9 | 70.0 | 71.0 |
| 1400 | 41.6 | 41.6 | 43.0 | 43.0 | 44.0 | 46.0 | 46.0 | 46.9 | 46.9 | 46.9 | 49.6 | 49.6 | 51.1 | 52.0 | 53.7 | 58.1 | 58.5 | 60.2 | 60.2 | 61.2 | 64.0 | 65.9 | 65.9 | 68.9 | 72.0 |
| 1600 | 42.5 | 42.5 | 43.0 | 43.0 | 45.0 | 46.9 | 48.7 | 49.6 | 49.6 | 49.6 | 49.6 | 50.5 | 52.0 | 52.9 | 54.2 | 54.8 | 56.6 | 58.0 | 58.4 | 61.1 | 63.9 | 64.8 | 65.7 | 67.7 | 73.0 |
| 1800 | 42.5 | 42.5 | 43.0 | 43.0 | 45.0 | 46.9 | 48.7 | 49.6 | 49.6 | 49.6 | 49.6 | 50.5 | 52.9 | 54.8 | 54.8 | 54.8 | 56.6 | 58.4 | 58.4 | 61.1 | 63.9 | 64.8 | 65.7 | 68.7 | 74.0 |
| 2000 | 42.5 | 42.5 | 43.0 | 43.0 | 46.0 | 46.9 | 49.6 | 50.5 | 51.3 | 51.3 | 51.3 | 51.3 | 52.9 | 54.8 | 54.8 | 54.8 | 58.0 | 59.3 | 59.3 | 61.1 | 63.9 | 64.8 | 65.7 | 68.7 | 74.0 |
| 2500 | 42.5 | 42.5 | 43.0 | 43.0 | 46.0 | 47.8 | 49.6 | 50.5 | 53.1 | 53.1 | 53.1 | 53.1 | 54.9 | 55.8 | 54.9 | 58.6 | 58.4 | 58.4 | 58.4 | 62.1 | 63.9 | 65.7 | 65.7 | 69.6 | 74.0 |
| 3000 | 42.5 | 43.0 | 43.0 | 43.0 | 48.7 | 48.7 | 50.5 | 52.2 | 54.9 | 54.9 | 55.8 | 55.8 | 55.8 | 55.8 | 55.8 | 57.8 | 56.7 | 58.4 | 57.2 | 63.2 | 63.9 | 65.7 | 66.6 | 69.6 | 75.0 |
| 3500 | 42.5 | 43.4 | 44.3 | 43.4 | 47.8 | 48.7 | 48.7 | 50.5 | 49.6 | 54.9 | 54.9 | 54.9 | 54.9 | 54.9 | 54.9 | 56.0 | 54.9 | 56.4 | 57.1 | 63.9 | 63.9 | 65.7 | 66.6 | 69.6 | 75.0 |
| 4000 | 42.5 | 43.4 | 44.2 | 44.3 | 48.7 | 48.7 | 48.7 | 49.6 | 49.6 | 49.6 | 49.6 | 49.6 | 50.5 | 50.5 | 52.9 | 55.5 | 55.3 | 56.0 | 57.2 | 63.9 | 63.9 | 66.6 | 66.6 | 69.6 | 74.0 |
| 4500 | 42.5 | 43.4 | 44.2 | 44.3 | 46.0 | 46.0 | 46.9 | 46.9 | 47.8 | 47.8 | 47.8 | 48.7 | 48.7 | 50.5 | 53.0 | 55.6 | 55.3 | 56.5 | 57.3 | 63.9 | 63.9 | 66.6 | 66.6 | 68.7 | 73.0 |
| 5000 | 42.5 | 43.4 | 44.2 | 44.3 | 44.3 | 44.2 | 44.2 | 44.2 | 44.2 | 44.3 | 44.3 | 44.3 | 45.1 | 46.0 | 53.1 | 55.7 | 55.5 | 57.3 | 57.5 | 63.9 | 63.9 | 65.7 | 65.7 | 68.7 | 73.0 |
| 5750 | 42.5 | 42.5 | 44.3 | 44.3 | 44.3 | 44.3 | 44.3 | 44.3 | 44.3 | 44.3 | 44.3 | 44.3 | 44.3 | 46.0 | 53.1 | 55.7 | 55.6 | 57.3 | 57.5 | 63.9 | 63.9 | 64.8 | 64.8 | 67.7 | 72.0 |
| 6500 | 41.6 | 41.6 | 41.6 | 41.6 | 41.6 | 41.6 | 41.6 | 41.6 | 41.6 | 41.6 | 41.6 | 41.6 | 45.1 | 46.0 | 53.1 | 55.8 | 55.7 | 57.5 | 57.5 | 63.9 | 63.0 | 63.9 | 63.9 | 65.9 | 71.0 |
| 7250 | 39.8 | 39.8 | 39.8 | 39.8 | 39.8 | 39.8 | 39.8 | 39.8 | 39.8 | 39.8 | 39.8 | 39.8 | 44.3 | 44.3 | 47.0 | 50.0 | 52.0 | 53.0 | 54.0 | 59.3 | 60.2 | 62.1 | 63.0 | 65.9 | 70.0 |
| 8000 | 39.8 | 39.8 | 39.8 | 39.8 | 39.8 | 39.8 | 39.8 | 39.8 | 39.8 | 39.8 | 39.8 | 39.8 | 42.0 | 42.0 | 46.0 | 48.0 | 49.0 | 50.0 | 48.7 | 54.8 | 59.3 | 61.1 | 62.1 | 65.9 | 70.0 |

202 204 212 208 206 210

FIG. 2

126' kPa

| RPM | 10 | 15 | 20 | 25 | 30 | 35 | 40 | 45 | 50 | 55 | 60 | 65 | 70 | 75 | 80 | 85 | 90 | 95 | 100 | 105 | 120 | 140 | 160 | 180 | 199 |
|---|---|---|---|---|---|---|---|---|---|---|---|---|---|---|---|---|---|---|---|---|---|---|---|---|---|
| 200 | 41.0 | 41.0 | 42.0 | 42.0 | 42.0 | 42.0 | 42.0 | 42.0 | 42.0 | 42.0 | 43.0 | 44.0 | 45.6 | 49.3 | 51.7 | 52.0 | 52.0 | 52.0 | 53.0 | 54.0 | 56.0 | 61.1 | 62.1 | 64.0 | 70.0 |
| 400 | 41.0 | 41.0 | 42.0 | 42.0 | 42.0 | 42.0 | 42.0 | 42.0 | 42.0 | 42.0 | 43.0 | 44.0 | 45.6 | 50.2 | 51.7 | 58.2 | 59.2 | 59.2 | 61.1 | 61.1 | 62.1 | 62.1 | 63.1 | 65.0 | 70.0 |
| 600 | 41.0 | 41.6 | 42.0 | 42.0 | 42.0 | 42.0 | 42.0 | 42.0 | 42.0 | 42.0 | 43.0 | 44.0 | 46.5 | 48.4 | 51.7 | 59.4 | 59.9 | 63.1 | 63.1 | 64.0 | 64.0 | 65.0 | 66.9 | 70.0 | 70.0 |
| 800 | 41.0 | 41.6 | 42.0 | 42.0 | 42.5 | 42.5 | 42.5 | 42.5 | 42.5 | 43.0 | 44.0 | 44.0 | 47.5 | 50.2 | 53.6 | 59.3 | 59.8 | 63.1 | 63.1 | 64.0 | 65.0 | 66.0 | 66.9 | 70.0 | 70.0 |
| 1000 | 41.6 | 41.6 | 42.0 | 43.0 | 43.0 | 43.0 | 43.4 | 43.4 | 43.4 | 43.4 | 43.4 | 44.3 | 49.0 | 48.8 | 55.1 | 61.1 | 60.9 | 63.0 | 63.1 | 64.0 | 65.0 | 66.0 | 67.9 | 70.0 | 70.0 |
| 1200 | 41.6 | 41.6 | 42.0 | 43.0 | 43.0 | 43.0 | 43.7 | 44.0 | 44.4 | 46.0 | 46.0 | 46.9 | 49.3 | 51.1 | 55.3 | 61.2 | 60.4 | 62.7 | 63.1 | 63.1 | 66.0 | 67.9 | 67.9 | 70.0 | 71.0 |
| 1400 | 41.6 | 41.6 | 43.0 | 43.0 | 44.0 | 46.0 | 46.0 | 46.9 | 46.9 | 46.9 | 49.6 | 49.6 | 51.1 | 52.0 | 53.7 | 58.1 | 58.5 | 60.2 | 60.2 | 61.2 | 64.0 | 65.9 | 65.9 | 68.9 | 72.0 |
| 1600 | 42.5 | 42.5 | 43.0 | 43.0 | 45.0 | 46.9 | 48.7 | 49.6 | 49.6 | 49.6 | 49.6 | 50.5 | 52.0 | 52.9 | 54.2 | 54.8 | 56.6 | 58.0 | 58.4 | 61.1 | 63.9 | 64.8 | 65.7 | 67.7 | 73.0 |
| 1800 | 42.5 | 42.5 | 43.0 | 43.0 | 45.0 | 46.9 | 48.7 | 49.6 | 49.6 | 49.6 | 49.6 | 50.5 | 52.9 | 54.8 | 54.8 | 54.8 | 56.6 | 58.4 | 58.4 | 61.1 | 63.9 | 64.8 | 65.7 | 68.7 | 74.0 |
| 2000 | 42.5 | 42.5 | 43.0 | 43.0 | 46.0 | 46.9 | 49.6 | 50.5 | 51.3 | 51.3 | 51.3 | 49.2 | 50.8 | 54.8 | 54.8 | 54.8 | 58.0 | 59.3 | 59.3 | 61.1 | 63.9 | 64.8 | 65.7 | 68.7 | 74.0 |
| 2500 | 42.5 | 42.5 | 43.0 | 43.0 | 46.0 | 47.8 | 49.6 | 50.5 | 53.1 | 53.1 | 53.1 | 51.0 | 52.7 | 55.8 | 54.9 | 58.6 | 58.4 | 58.4 | 58.4 | 62.1 | 63.9 | 65.7 | 65.7 | 69.6 | 74.0 |
| 3000 | 42.5 | 43.0 | 43.0 | 43.0 | 48.7 | 48.7 | 50.5 | 52.2 | 54.9 | 54.9 | 55.8 | 55.8 | 55.8 | 55.8 | 55.8 | 57.8 | 56.7 | 58.4 | 57.2 | 63.2 | 63.9 | 65.7 | 66.6 | 69.6 | 75.0 |
| 3500 | 42.5 | 43.4 | 44.3 | 43.4 | 47.8 | 48.7 | 48.7 | 50.5 | 49.6 | 54.9 | 54.9 | 54.9 | 54.9 | 54.9 | 54.9 | 56.0 | 54.9 | 56.4 | 57.1 | 63.9 | 63.9 | 65.7 | 66.6 | 69.6 | 75.0 |
| 4000 | 42.5 | 43.4 | 44.2 | 44.3 | 48.7 | 48.7 | 48.7 | 49.6 | 49.6 | 49.6 | 49.6 | 49.6 | 50.5 | 50.5 | 52.9 | 55.5 | 55.3 | 56.0 | 57.2 | 63.9 | 63.9 | 66.6 | 66.6 | 69.6 | 74.0 |
| 4500 | 42.5 | 43.4 | 44.2 | 44.3 | 46.0 | 46.0 | 46.9 | 46.9 | 47.8 | 47.8 | 47.8 | 48.7 | 48.7 | 50.5 | 53.0 | 55.6 | 55.3 | 56.5 | 57.3 | 63.9 | 63.9 | 66.6 | 66.6 | 68.7 | 73.0 |
| 5000 | 42.5 | 43.4 | 44.2 | 44.3 | 44.3 | 44.2 | 44.2 | 44.2 | 44.2 | 44.3 | 44.3 | 44.3 | 45.1 | 46.0 | 53.1 | 55.7 | 55.5 | 57.3 | 57.5 | 63.9 | 63.9 | 65.7 | 65.7 | 68.7 | 73.0 |
| 5750 | 42.5 | 42.5 | 44.3 | 44.3 | 44.3 | 44.3 | 44.3 | 44.3 | 44.3 | 44.3 | 44.3 | 44.3 | 44.3 | 46.0 | 53.1 | 55.7 | 55.6 | 57.3 | 57.5 | 63.9 | 63.9 | 64.8 | 64.8 | 67.7 | 72.0 |
| 6500 | 41.6 | 41.6 | 41.6 | 41.6 | 41.6 | 41.6 | 41.6 | 41.6 | 41.6 | 41.6 | 41.6 | 41.6 | 45.1 | 46.0 | 53.1 | 55.8 | 55.7 | 57.5 | 57.5 | 63.9 | 63.0 | 63.9 | 63.9 | 65.9 | 71.0 |
| 7250 | 39.8 | 39.8 | 39.8 | 39.8 | 39.8 | 39.8 | 39.8 | 39.8 | 39.8 | 39.8 | 39.8 | 39.8 | 44.3 | 44.3 | 47.0 | 50.0 | 52.0 | 53.0 | 54.0 | 59.3 | 60.2 | 62.1 | 63.0 | 65.9 | 70.0 |
| 8000 | 39.8 | 39.8 | 39.8 | 39.8 | 39.8 | 39.8 | 39.8 | 39.8 | 39.8 | 39.8 | 39.8 | 39.8 | 42.0 | 42.0 | 46.0 | 48.0 | 49.0 | 50.0 | 48.7 | 54.8 | 59.3 | 61.1 | 62.1 | 65.9 | 70.0 |

204 222 224

FIG. 3

232 230

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

FIG. 5

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

240

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

FIG. 6

260 262

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

260 262

| | | | |
|---|---|---|---|
| 49.6 | 50.5 | 52.9 | 54.8 |
| 51.3 | 49.2 | 50.8 | 54.8 |
| 53.1 | 51.0 | 52.7 | 55.8 |
| 55.8 | 55.8 | 55.8 | 55.8 |

126 kPa

| RPM | 10 | 15 | 20 | 25 | 30 | 35 | 40 | 45 | 50 | 55 | 60 | 65 | 70 | 75 | 80 | 85 | 90 | 95 | 100 | 105 | 120 | 140 | 160 | 180 | 199 |
|---|---|---|---|---|---|---|---|---|---|---|---|---|---|---|---|---|---|---|---|---|---|---|---|---|---|
| 200 | 41.0 | 41.0 | 42.0 | 42.0 | 42.0 | 42.0 | 42.0 | 42.0 | 42.0 | 42.0 | 43.0 | 44.0 | 45.6 | 49.3 | 51.7 | 52.0 | 52.0 | 52.0 | 53.0 | 54.0 | 56.0 | 61.1 | 62.1 | 64.0 | 70.0 |
| 400 | 41.0 | 41.0 | 42.0 | 42.0 | 42.0 | 42.0 | 42.0 | 42.0 | 42.0 | 42.0 | 43.0 | 44.0 | 45.6 | 50.2 | 51.7 | 58.2 | 59.2 | 59.2 | 61.1 | 61.1 | 62.1 | 62.1 | 63.1 | 65.0 | 70.0 |
| 600 | 41.0 | 41.6 | 42.0 | 42.0 | 42.0 | 42.0 | 42.0 | 42.0 | 42.0 | 42.0 | 43.0 | 44.0 | 46.5 | 48.4 | 51.7 | 59.4 | 59.9 | 63.1 | 63.1 | 64.0 | 64.0 | 65.0 | 66.9 | 70.0 | 70.0 |
| 800 | 41.0 | 41.6 | 42.0 | 42.0 | 42.5 | 42.5 | 42.5 | 42.5 | 42.5 | 43.0 | 44.0 | 44.0 | 47.5 | 50.2 | 53.6 | 59.3 | 59.8 | 63.1 | 63.1 | 64.0 | 65.0 | 66.0 | 66.9 | 70.0 | 70.0 |
| 1000 | 41.6 | 41.6 | 42.0 | 43.0 | 43.0 | 43.0 | 43.4 | 43.4 | 43.4 | 43.4 | 43.4 | 44.3 | 49.0 | 48.8 | 55.1 | 61.1 | 60.9 | 63.0 | 63.1 | 64.0 | 65.0 | 66.0 | 67.9 | 70.0 | 70.0 |
| 1200 | 41.6 | 41.6 | 42.0 | 43.0 | 43.0 | 43.0 | 43.7 | 44.0 | 44.4 | 46.0 | 46.0 | 46.9 | 49.3 | 51.1 | 55.3 | 61.2 | 60.4 | 62.7 | 63.1 | 63.1 | 66.0 | 67.9 | 67.9 | 70.0 | 71.0 |
| 1400 | 41.6 | 41.6 | 43.0 | 43.0 | 44.0 | 46.0 | 46.0 | 46.9 | 46.9 | 46.9 | 49.6 | 49.6 | 51.1 | 52.0 | 53.7 | 58.1 | 58.5 | 60.2 | 60.2 | 61.2 | 64.0 | 65.9 | 65.9 | 68.9 | 72.0 |
| 1600 | 42.5 | 42.5 | 43.0 | 43.0 | 45.0 | 46.9 | 48.7 | 49.6 | 49.6 | 49.6 | 49.6 | 50.5 | 52.0 | 52.9 | 54.2 | 54.8 | 56.6 | 58.0 | 58.4 | 61.1 | 63.9 | 64.8 | 65.7 | 67.7 | 73.0 |
| 1800 | 42.5 | 42.5 | 43.0 | 43.0 | 45.0 | 46.9 | 48.7 | 49.6 | 49.6 | 49.6 | 49.6 | 50.5 | 52.9 | 54.8 | 54.8 | 54.8 | 56.6 | 58.4 | 58.4 | 61.1 | 63.9 | 64.8 | 65.7 | 68.7 | 74.0 |
| 2000 | 42.5 | 42.5 | 43.0 | 43.0 | 46.0 | 46.9 | 49.6 | 50.5 | 51.3 | 51.3 | 51.3 | 51.3 | 52.9 | 54.8 | 54.8 | 54.8 | 58.0 | 59.3 | 59.3 | 61.1 | 63.9 | 64.8 | 65.7 | 68.7 | 74.0 |
| 2500 | 42.5 | 42.5 | 43.0 | 43.0 | 46.0 | 47.8 | 49.6 | 50.5 | 53.1 | 53.1 | 53.1 | 53.1 | 54.9 | 55.8 | 54.9 | 58.6 | 58.4 | 58.4 | 58.4 | 62.1 | 63.9 | 65.7 | 65.7 | 69.6 | 74.0 |
| 3000 | 42.5 | 43.0 | 43.0 | 43.0 | 48.7 | 48.7 | 50.5 | 52.2 | 54.9 | 54.9 | 55.8 | 55.8 | 55.8 | 55.8 | 55.8 | 57.8 | 56.7 | 58.4 | 57.2 | 63.2 | 63.9 | 65.7 | 66.6 | 69.6 | 75.0 |
| 3500 | 42.5 | 43.4 | 44.3 | 43.4 | 47.8 | 48.7 | 48.7 | 50.5 | 49.6 | 54.9 | 54.9 | 54.9 | 54.9 | 54.9 | 54.9 | 56.0 | 54.9 | 56.4 | 57.1 | 63.9 | 63.9 | 65.7 | 66.6 | 69.6 | 75.0 |
| 4000 | 42.5 | 43.4 | 44.2 | 44.3 | 48.7 | 48.7 | 48.7 | 49.6 | 49.6 | 49.6 | 49.6 | 49.6 | 50.5 | 50.5 | 52.0 | 55.5 | 55.3 | 56.0 | 57.2 | 63.9 | 63.9 | 66.6 | 66.6 | 69.6 | 74.0 |
| 4500 | 42.5 | 43.4 | 44.2 | 44.3 | 46.0 | 46.0 | 46.9 | 46.9 | 47.8 | 47.8 | 47.8 | 48.7 | 48.7 | 50.5 | 53.0 | 55.6 | 55.3 | 56.5 | 57.3 | 63.9 | 63.9 | 66.6 | 66.6 | 68.7 | 73.0 |
| 5000 | 42.5 | 43.4 | 44.2 | 44.3 | 44.3 | 44.2 | 44.2 | 44.2 | 44.2 | 44.3 | 44.3 | 44.3 | 45.1 | 46.0 | 53.1 | 55.7 | 55.5 | 57.3 | 57.5 | 63.9 | 63.9 | 65.7 | 65.7 | 68.7 | 73.0 |
| 5750 | 42.5 | 42.5 | 44.3 | 44.3 | 44.3 | 44.3 | 44.3 | 44.3 | 44.3 | 44.3 | 44.3 | 44.3 | 44.3 | 46.0 | 53.1 | 55.7 | 55.6 | 57.3 | 57.5 | 63.9 | 63.9 | 64.8 | 64.8 | 67.7 | 72.0 |
| 6500 | 41.6 | 41.6 | 41.6 | 41.6 | 41.6 | 41.6 | 41.6 | 41.6 | 41.6 | 41.6 | 41.6 | 41.6 | 45.1 | 46.0 | 53.1 | 55.8 | 55.7 | 57.5 | 57.5 | 63.9 | 63.0 | 63.9 | 63.9 | 65.9 | 71.0 |
| 7250 | 39.8 | 39.8 | 39.8 | 39.8 | 39.8 | 39.8 | 39.8 | 39.8 | 39.8 | 39.8 | 39.8 | 39.8 | 44.3 | 44.3 | 47.0 | 50.0 | 52.0 | 53.0 | 54.0 | 59.3 | 60.2 | 62.1 | 63.0 | 65.9 | 70.0 |
| 8000 | 39.8 | 39.8 | 39.8 | 39.8 | 39.8 | 39.8 | 39.8 | 39.8 | 39.8 | 39.8 | 39.8 | 39.8 | 42.0 | 42.0 | 46.0 | 48.0 | 49.0 | 50.0 | 48.7 | 54.8 | 59.3 | 61.1 | 62.1 | 65.9 | 70.0 |

204 226a 212a 230B 230A 226c 212c

FIG. 10

126 kPa

| RPM | 10 | 15 | 20 | 25 | 30 | 35 | 40 | 45 | 50 | 55 | 60 | 65 | 70 | 75 | 80 | 85 | 90 | 95 | 100 | 105 | 120 | 140 | 160 | 180 | 199 |
|---|---|---|---|---|---|---|---|---|---|---|---|---|---|---|---|---|---|---|---|---|---|---|---|---|---|
| 200 | 41.0 | 41.0 | 42.0 | 42.0 | 42.0 | 42.0 | 42.0 | 42.0 | 42.0 | 42.0 | 43.0 | 44.0 | 45.6 | 49.3 | 51.7 | 52.0 | 52.0 | 52.0 | 53.0 | 54.0 | 56.0 | 61.1 | 62.1 | 64.0 | 70.0 |
| 400 | 41.0 | 41.0 | 42.0 | 42.0 | 42.0 | 42.0 | 42.0 | 42.0 | 42.0 | 42.0 | 43.0 | 44.0 | 45.6 | 50.2 | 51.7 | 58.2 | 59.2 | 59.2 | 61.1 | 61.1 | 62.1 | 62.1 | 63.1 | 65.0 | 70.0 |
| 600 | 41.0 | 41.6 | 42.0 | 42.0 | 42.0 | 42.0 | 42.0 | 42.0 | 42.0 | 42.0 | 43.0 | 44.0 | 46.5 | 48.4 | 51.7 | 59.4 | 59.9 | 63.1 | 63.1 | 64.0 | 64.0 | 65.0 | 66.9 | 70.0 | 70.0 |
| 800 | 41.0 | 41.6 | 42.0 | 42.0 | 42.5 | 42.5 | 42.5 | 42.5 | 42.5 | 43.0 | 44.0 | 44.0 | 47.5 | 50.2 | 53.6 | 59.3 | 59.8 | 63.1 | 63.1 | 64.0 | 65.0 | 66.0 | 66.9 | 70.0 | 70.0 |
| 1000 | 41.6 | 41.6 | 42.0 | 43.0 | 43.0 | 43.0 | 43.4 | 43.4 | 43.4 | 43.4 | 43.4 | 44.3 | 49.0 | 48.8 | 55.1 | 61.1 | 60.9 | 63.0 | 63.1 | 64.0 | 65.0 | 66.0 | 67.9 | 70.0 | 70.0 |
| 1200 | 41.6 | 41.6 | 42.0 | 43.0 | 43.0 | 43.0 | 43.7 | 44.0 | 44.4 | 46.0 | 46.0 | 46.9 | 49.3 | 51.1 | 55.3 | 61.2 | 60.4 | 62.7 | 63.1 | 63.1 | 66.0 | 67.9 | 67.9 | 70.0 | 71.0 |
| 1400 | 41.6 | 41.6 | 43.0 | 43.0 | 44.0 | 46.0 | 46.0 | 46.9 | 46.9 | 46.9 | 49.6 | 49.6 | 51.1 | 52.0 | 53.7 | 58.1 | 58.5 | 60.2 | 60.2 | 61.2 | 64.0 | 65.9 | 65.9 | 68.9 | 72.0 |
| 1600 | 42.5 | 42.5 | 43.0 | 43.0 | 45.0 | 46.9 | 48.7 | 49.6 | 49.6 | 49.6 | 49.6 | 50.5 | 52.0 | 52.9 | 54.2 | 54.8 | 56.6 | 58.0 | 58.4 | 61.1 | 63.9 | 64.8 | 65.7 | 67.7 | 73.0 |
| 1800 | 42.5 | 42.5 | 43.0 | 43.0 | 45.0 | 46.9 | 48.7 | 49.6 | 49.6 | 49.6 | 49.6 | 50.5 | 52.9 | 54.8 | 54.8 | 54.8 | 56.6 | 58.4 | 58.4 | 61.1 | 63.9 | 64.8 | 65.7 | 68.7 | 74.0 |
| 2000 | 42.5 | 42.5 | 43.0 | 43.0 | 46.0 | 46.9 | 49.6 | 50.5 | 51.3 | 51.3 | 51.3 | 51.3 | 52.9 | 54.8 | 54.8 | 54.8 | 58.0 | 59.3 | 59.3 | 61.1 | 63.9 | 64.8 | 65.7 | 68.7 | 74.0 |
| 2500 | 42.5 | 42.5 | 43.0 | 43.0 | 46.0 | 47.8 | 49.6 | 50.5 | 53.1 | 53.1 | 53.1 | 53.1 | 54.9 | 55.8 | 54.9 | 58.6 | 58.4 | 58.4 | 58.4 | 62.1 | 63.9 | 65.7 | 65.7 | 69.6 | 74.0 |
| 3000 | 42.5 | 43.0 | 43.0 | 43.0 | 48.7 | 48.7 | 50.5 | 52.2 | 54.9 | 54.9 | 55.8 | 55.8 | 55.8 | 55.8 | 55.8 | 57.8 | 56.7 | 58.4 | 57.2 | 63.2 | 63.9 | 65.7 | 66.6 | 69.6 | 75.0 |
| 3500 | 42.5 | 43.4 | 44.3 | 43.4 | 47.8 | 48.7 | 48.7 | 50.5 | 49.6 | 54.9 | 54.9 | 54.9 | 54.9 | 54.9 | 54.9 | 56.0 | 54.9 | 56.4 | 57.1 | 63.9 | 63.9 | 65.7 | 66.6 | 69.6 | 75.0 |
| 4000 | 42.5 | 43.4 | 44.2 | 44.3 | 48.7 | 48.7 | 48.7 | 49.6 | 49.6 | 49.6 | 49.6 | 49.6 | 50.5 | 50.5 | 52.9 | 55.5 | 55.3 | 56.0 | 57.2 | 63.9 | 63.9 | 66.6 | 66.6 | 69.6 | 74.0 |
| 4500 | 42.5 | 43.4 | 44.2 | 44.3 | 46.0 | 46.0 | 46.9 | 46.9 | 47.8 | 47.8 | 47.8 | 48.7 | 48.7 | 50.5 | 53.0 | 55.6 | 55.3 | 56.5 | 57.3 | 63.9 | 63.9 | 66.6 | 66.6 | 68.7 | 73.0 |
| 5000 | 42.5 | 43.4 | 44.2 | 44.3 | 44.3 | 44.2 | 44.2 | 44.2 | 44.2 | 44.3 | 44.3 | 44.3 | 45.1 | 46.0 | 53.1 | 55.7 | 55.5 | 57.3 | 57.5 | 63.9 | 63.9 | 65.7 | 65.7 | 68.7 | 73.0 |
| 5750 | 42.5 | 42.5 | 44.3 | 44.3 | 44.3 | 44.3 | 44.3 | 44.3 | 44.3 | 44.3 | 44.3 | 44.3 | 44.3 | 46.0 | 53.1 | 55.7 | 55.6 | 57.3 | 57.5 | 63.9 | 63.9 | 64.8 | 64.8 | 67.7 | 72.0 |
| 6500 | 41.6 | 41.6 | 41.6 | 41.6 | 41.6 | 41.6 | 41.6 | 41.6 | 41.6 | 41.6 | 41.6 | 41.6 | 45.1 | 46.0 | 53.1 | 55.8 | 55.7 | 57.5 | 57.5 | 63.9 | 63.0 | 63.9 | 63.9 | 65.9 | 71.0 |
| 7250 | 39.8 | 39.8 | 39.8 | 39.8 | 39.8 | 39.8 | 39.8 | 39.8 | 39.8 | 39.8 | 39.8 | 39.8 | 44.3 | 44.3 | 47.0 | 50.0 | 52.0 | 53.0 | 54.0 | 59.3 | 60.2 | 62.1 | 63.0 | 65.9 | 70.0 |
| 8000 | 39.8 | 39.8 | 39.8 | 39.8 | 39.8 | 39.8 | 39.8 | 39.8 | 39.8 | 39.8 | 39.8 | 39.8 | 42.0 | 42.0 | 46.0 | 48.0 | 49.0 | 50.0 | 48.7 | 54.8 | 59.3 | 61.1 | 62.1 | 65.9 | 70.0 |

204 238A 230A

FIG. 11

126 kPa

| RPM | 10 | 15 | 20 | 25 | 30 | 35 | 40 | 45 | 50 | 55 | 60 | 65 | 70 | 75 | 80 | 85 | 90 | 95 | 100 | 105 | 120 | 140 | 160 | 180 | 199 |
|---|---|---|---|---|---|---|---|---|---|---|---|---|---|---|---|---|---|---|---|---|---|---|---|---|---|
| 200 | 41.0 | 41.0 | 42.0 | 42.0 | 42.0 | 42.0 | 42.0 | 42.0 | 42.0 | 42.0 | 43.0 | 44.0 | 45.6 | 49.3 | 51.7 | 52.0 | 52.0 | 52.0 | 53.0 | 54.0 | 56.0 | 61.1 | 62.1 | 64.0 | 70.0 |
| 400 | 41.0 | 41.0 | 42.0 | 42.0 | 42.0 | 42.0 | 42.0 | 42.0 | 42.0 | 42.0 | 43.0 | 44.0 | 45.6 | 50.2 | 51.7 | 58.2 | 59.2 | 59.2 | 61.1 | 61.1 | 62.1 | 62.1 | 63.1 | 65.0 | 70.0 |
| 600 | 41.0 | 41.6 | 42.0 | 42.0 | 42.0 | 42.0 | 42.0 | 42.0 | 42.0 | 42.0 | 43.0 | 44.0 | 46.5 | 48.4 | 51.7 | 59.4 | 59.9 | 63.1 | 63.1 | 64.0 | 64.0 | 65.0 | 66.9 | 70.0 | 70.0 |
| 800 | 41.0 | 41.6 | 42.0 | 42.0 | 42.5 | 42.5 | 42.5 | 42.5 | 42.5 | 43.0 | 44.0 | 44.0 | 47.5 | 50.2 | 53.6 | 59.3 | 59.8 | 63.1 | 63.1 | 64.0 | 65.0 | 66.0 | 66.9 | 70.0 | 70.0 |
| 1000 | 41.6 | 41.6 | 42.0 | 43.0 | 43.0 | 43.0 | 43.4 | 43.4 | 43.4 | 43.4 | 43.4 | 44.3 | 49.0 | 48.8 | 55.1 | 61.1 | 60.9 | 63.0 | 63.1 | 64.0 | 65.0 | 66.0 | 67.9 | 70.0 | 70.0 |
| 1200 | 41.6 | 41.6 | 42.0 | 43.0 | 43.0 | 43.0 | 43.7 | 44.0 | 44.4 | 46.0 | 46.0 | 46.9 | 49.3 | 51.1 | 55.3 | 61.2 | 60.4 | 62.7 | 63.1 | 63.1 | 66.0 | 67.9 | 67.9 | 70.0 | 71.0 |
| 1400 | 41.6 | 41.6 | 43.0 | 43.0 | 44.0 | 46.0 | 46.0 | 46.9 | 46.9 | 46.9 | 49.6 | 49.6 | 51.1 | 52.0 | 53.7 | 58.1 | 58.5 | 60.2 | 60.2 | 61.2 | 64.0 | 65.9 | 65.9 | 68.9 | 72.0 |
| 1600 | 42.5 | 42.5 | 43.0 | 43.0 | 45.0 | 46.9 | 48.7 | 49.6 | 49.6 | 49.6 | 49.6 | 50.5 | 52.0 | 52.9 | 54.2 | 54.8 | 56.6 | 58.0 | 58.4 | 61.1 | 63.9 | 64.8 | 65.7 | 67.7 | 73.0 |
| 1800 | 42.5 | 42.5 | 43.0 | 43.0 | 45.0 | 46.9 | 48.7 | 49.6 | 49.6 | 49.6 | 49.6 | 50.5 | 52.9 | 54.8 | 54.8 | 54.8 | 56.6 | 58.4 | 58.4 | 61.1 | 63.9 | 64.8 | 65.7 | 68.7 | 74.0 |
| 2000 | 42.5 | 42.5 | 43.0 | 43.0 | 46.0 | 46.9 | 49.6 | 50.5 | 51.3 | 51.3 | 51.3 | 51.3 | 52.9 | 54.8 | 54.8 | 54.8 | 58.0 | 59.3 | 59.3 | 61.1 | 63.9 | 64.8 | 65.7 | 68.7 | 74.0 |
| 2500 | 42.5 | 42.5 | 43.0 | 43.0 | 46.0 | 47.8 | 49.6 | 50.5 | 53.1 | 53.1 | 53.1 | 53.1 | 54.9 | 55.8 | 54.9 | 58.6 | 58.4 | 58.4 | 58.4 | 62.1 | 63.9 | 65.7 | 65.7 | 69.6 | 74.0 |
| 3000 | 42.5 | 43.0 | 43.0 | 43.0 | 48.7 | 48.7 | 50.5 | 52.2 | 54.9 | 54.9 | 55.8 | 55.8 | 55.8 | 55.8 | 55.8 | 57.8 | 56.7 | 58.4 | 57.2 | 63.2 | 63.9 | 65.7 | 66.6 | 69.6 | 75.0 |
| 3500 | 42.5 | 43.4 | 44.3 | 43.4 | 47.8 | 48.7 | 48.7 | 50.5 | 49.6 | 54.9 | 54.9 | 54.9 | 54.9 | 54.9 | 54.9 | 56.0 | 54.9 | 56.4 | 57.1 | 63.9 | 63.9 | 65.7 | 66.6 | 69.6 | 75.0 |
| 4000 | 42.5 | 43.4 | 44.2 | 44.3 | 48.7 | 48.7 | 48.7 | 49.6 | 49.6 | 49.6 | 49.6 | 49.6 | 50.5 | 50.5 | 52.9 | 55.5 | 55.3 | 56.0 | 57.2 | 63.9 | 63.9 | 66.6 | 66.6 | 69.6 | 74.0 |
| 4500 | 42.5 | 43.4 | 44.2 | 44.3 | 46.0 | 46.0 | 46.9 | 46.9 | 47.8 | 47.8 | 47.8 | 48.7 | 48.7 | 50.5 | 53.0 | 55.6 | 55.3 | 56.5 | 57.3 | 63.9 | 63.9 | 66.6 | 66.6 | 68.7 | 73.0 |
| 5000 | 42.5 | 43.4 | 44.2 | 44.3 | 44.3 | 44.2 | 44.2 | 44.2 | 44.2 | 44.3 | 44.3 | 44.3 | 45.1 | 46.0 | 53.1 | 55.7 | 55.5 | 57.3 | 57.5 | 63.9 | 63.9 | 65.7 | 65.7 | 68.7 | 73.0 |
| 5750 | 42.5 | 42.5 | 44.3 | 44.3 | 44.3 | 44.3 | 44.3 | 44.3 | 44.3 | 44.3 | 44.3 | 44.3 | 44.3 | 46.0 | 53.1 | 55.7 | 55.6 | 57.3 | 57.5 | 63.9 | 63.9 | 64.8 | 64.8 | 67.7 | 72.0 |
| 6500 | 41.6 | 41.6 | 41.6 | 41.6 | 41.6 | 41.6 | 41.6 | 41.6 | 41.6 | 41.6 | 41.6 | 41.6 | 45.1 | 46.0 | 53.1 | 55.8 | 55.7 | 57.5 | 57.5 | 63.9 | 63.0 | 63.9 | 63.9 | 65.9 | 71.0 |
| 7250 | 39.8 | 39.8 | 39.8 | 39.8 | 39.8 | 39.8 | 39.8 | 39.8 | 39.8 | 39.8 | 39.8 | 39.8 | 44.3 | 44.3 | 47.0 | 50.0 | 52.0 | 53.0 | 54.0 | 59.3 | 60.2 | 62.1 | 63.0 | 65.9 | 70.0 |
| 8000 | 39.8 | 39.8 | 39.8 | 39.8 | 39.8 | 39.8 | 39.8 | 39.8 | 39.8 | 39.8 | 39.8 | 39.8 | 42.0 | 42.0 | 46.0 | 48.0 | 49.0 | 50.0 | 48.7 | 54.8 | 59.3 | 61.1 | 62.1 | 65.9 | 70.0 |

204 238B 230B

FIG. 12

126 kPa

| RPM | 10 | 15 | 20 | 25 | 30 | 35 | 40 | 45 | 50 | 55 | 60 | 65 | 70 | 75 | 80 | 85 | 90 | 95 | 100 | 105 | 120 | 140 | 160 | 180 | 199 |
|---|---|---|---|---|---|---|---|---|---|---|---|---|---|---|---|---|---|---|---|---|---|---|---|---|---|
| 200 | 41.0 | 41.0 | 42.0 | 42.0 | 42.0 | 42.0 | 42.0 | 42.0 | 42.0 | 42.0 | 43.0 | 44.0 | 45.6 | 49.3 | 51.7 | 52.0 | 52.0 | 52.0 | 53.0 | 54.0 | 56.0 | 61.1 | 62.1 | 64.0 | 70.0 |
| 400 | 41.0 | 41.0 | 42.0 | 42.0 | 42.0 | 42.0 | 42.0 | 42.0 | 42.0 | 42.0 | 43.0 | 44.0 | 45.6 | 50.2 | 51.7 | 58.2 | 59.2 | 59.2 | 61.1 | 61.1 | 62.1 | 62.1 | 63.1 | 65.0 | 70.0 |
| 600 | 41.0 | 41.6 | 42.0 | 42.0 | 42.0 | 42.0 | 42.0 | 42.0 | 42.0 | 42.0 | 43.0 | 44.0 | 46.5 | 48.4 | 51.7 | 59.4 | 59.9 | 63.1 | 63.1 | 64.0 | 64.0 | 65.0 | 66.9 | 70.0 | 70.0 |
| 800 | 41.0 | 41.6 | 42.0 | 42.0 | 42.5 | 42.5 | 42.5 | 42.5 | 42.5 | 43.0 | 44.0 | 44.0 | 47.5 | 50.2 | 53.6 | 59.3 | 59.8 | 63.1 | 63.1 | 64.0 | 65.0 | 66.0 | 66.9 | 70.0 | 70.0 |
| 1000 | 41.6 | 41.6 | 42.0 | 43.0 | 43.0 | 43.0 | 43.4 | 43.4 | 43.4 | 43.4 | 43.4 | 44.3 | 49.0 | 48.8 | 55.1 | 61.1 | 60.9 | 63.0 | 63.1 | 64.0 | 65.0 | 66.0 | 67.9 | 70.0 | 70.0 |
| 1200 | 41.6 | 41.6 | 42.0 | 43.0 | 43.0 | 43.0 | 43.7 | 44.0 | 44.4 | 46.0 | 46.0 | 46.9 | 49.3 | 51.1 | 55.3 | 61.2 | 60.4 | 62.7 | 63.1 | 63.1 | 66.0 | 67.9 | 67.9 | 70.0 | 71.0 |
| 1400 | 41.6 | 41.6 | 43.0 | 43.0 | 44.0 | 46.0 | 46.0 | 46.9 | 46.9 | 46.9 | 49.6 | 49.6 | 51.1 | 52.0 | 53.7 | 58.1 | 58.5 | 60.2 | 60.2 | 61.2 | 64.0 | 65.9 | 65.9 | 68.9 | 72.0 |
| 1600 | 42.5 | 42.5 | 43.0 | 43.0 | 45.0 | 46.9 | 48.7 | 49.6 | 49.6 | 49.6 | 49.6 | 50.5 | 52.0 | 52.9 | 54.2 | 54.8 | 56.6 | 58.0 | 58.4 | 61.1 | 63.9 | 64.8 | 65.7 | 67.7 | 73.0 |
| 1800 | 42.5 | 42.5 | 43.0 | 43.0 | 45.0 | 46.9 | 48.7 | 49.6 | 49.6 | 49.6 | 49.6 | 50.5 | 52.9 | 54.8 | 54.8 | 54.8 | 56.6 | 58.4 | 58.4 | 61.1 | 63.9 | 64.8 | 65.7 | 68.7 | 74.0 |
| 2000 | 42.5 | 42.5 | 43.0 | 43.0 | 46.0 | 46.9 | 49.6 | 50.5 | 51.3 | 51.3 | 51.3 | 51.3 | 52.9 | 54.8 | 54.8 | 54.8 | 58.0 | 59.3 | 59.3 | 61.1 | 63.9 | 64.8 | 65.7 | 68.7 | 74.0 |
| 2500 | 42.5 | 42.5 | 43.0 | 43.0 | 46.0 | 47.8 | 49.6 | 50.5 | 53.1 | 53.1 | 53.1 | 53.1 | 54.9 | 55.8 | 54.9 | 58.6 | 58.4 | 58.4 | 58.4 | 62.1 | 63.9 | 65.7 | 65.7 | 69.6 | 74.0 |
| 3000 | 42.5 | 43.0 | 43.0 | 43.0 | 48.7 | 48.7 | 50.5 | 52.2 | 54.9 | 54.9 | 55.8 | 55.8 | 55.8 | 55.8 | 55.8 | 57.8 | 56.7 | 58.4 | 57.2 | 63.2 | 63.9 | 65.7 | 66.6 | 69.6 | 75.0 |
| 3500 | 42.5 | 43.4 | 44.3 | 43.4 | 47.8 | 48.7 | 48.7 | 50.5 | 49.6 | 54.9 | 54.9 | 54.9 | 54.9 | 54.9 | 54.9 | 56.0 | 54.9 | 56.4 | 57.1 | 63.9 | 63.9 | 65.7 | 66.6 | 69.6 | 75.0 |
| 4000 | 42.5 | 43.4 | 44.2 | 44.3 | 48.7 | 48.7 | 48.7 | 49.6 | 49.6 | 49.6 | 49.6 | 49.6 | 50.5 | 50.5 | 52.9 | 55.5 | 55.3 | 56.0 | 57.2 | 63.9 | 63.9 | 66.6 | 66.6 | 69.6 | 74.0 |
| 4500 | 42.5 | 43.4 | 44.2 | 44.3 | 46.0 | 46.0 | 46.9 | 46.9 | 47.8 | 47.8 | 47.8 | 48.7 | 48.7 | 50.5 | 53.0 | 55.6 | 55.3 | 56.5 | 57.3 | 63.9 | 63.9 | 66.6 | 66.6 | 68.7 | 73.0 |
| 5000 | 42.5 | 43.4 | 44.2 | 44.3 | 44.3 | 44.2 | 44.2 | 44.2 | 44.2 | 44.3 | 44.3 | 44.3 | 45.1 | 46.0 | 53.1 | 55.7 | 55.5 | 57.3 | 57.5 | 63.9 | 63.9 | 65.7 | 65.7 | 68.7 | 73.0 |
| 5750 | 42.5 | 42.5 | 44.3 | 44.3 | 44.3 | 44.3 | 44.3 | 44.3 | 44.3 | 44.3 | 44.3 | 44.3 | 44.3 | 46.0 | 53.1 | 55.7 | 55.6 | 57.3 | 57.5 | 63.9 | 63.9 | 64.8 | 64.8 | 67.7 | 72.0 |
| 6500 | 41.6 | 41.6 | 41.6 | 41.6 | 41.6 | 41.6 | 41.6 | 41.6 | 41.6 | 41.6 | 41.6 | 41.6 | 45.1 | 46.0 | 53.1 | 55.8 | 55.7 | 57.5 | 57.5 | 63.9 | 63.0 | 63.9 | 63.9 | 65.9 | 71.0 |
| 7250 | 39.8 | 39.8 | 39.8 | 39.8 | 39.8 | 39.8 | 39.8 | 39.8 | 39.8 | 39.8 | 39.8 | 39.8 | 44.3 | 44.3 | 47.0 | 50.0 | 52.0 | 53.0 | 54.0 | 59.3 | 60.2 | 62.1 | 63.0 | 65.9 | 70.0 |
| 8000 | 39.8 | 39.8 | 39.8 | 39.8 | 39.8 | 39.8 | 39.8 | 39.8 | 39.8 | 39.8 | 39.8 | 39.8 | 42.0 | 42.0 | 46.0 | 48.0 | 49.0 | 50.0 | 48.7 | 54.8 | 59.3 | 61.1 | 62.1 | 65.9 | 70.0 |

204 226b 212b 230A

FIG. 14

126 kPa

| RPM | 10 | 15 | 20 | 25 | 30 | 35 | 40 | 45 | 50 | 55 | 60 | 65 | 70 | 75 | 80 | 85 | 90 | 95 | 100 | 105 | 120 | 140 | 160 | 180 | 199 |
|---|---|---|---|---|---|---|---|---|---|---|---|---|---|---|---|---|---|---|---|---|---|---|---|---|---|
| 200 | 41.0 | 41.0 | 42.0 | 42.0 | 42.0 | 42.0 | 42.0 | 42.0 | 42.0 | 42.0 | 43.0 | 44.0 | 45.6 | 49.3 | 51.7 | 52.0 | 52.0 | 52.0 | 53.0 | 54.0 | 56.0 | 61.1 | 62.1 | 64.0 | 70.0 |
| 400 | 41.0 | 41.0 | 42.0 | 42.0 | 42.0 | 42.0 | 42.0 | 42.0 | 42.0 | 42.0 | 43.0 | 44.0 | 45.6 | 50.2 | 51.7 | 58.2 | 59.2 | 59.2 | 61.1 | 61.1 | 62.1 | 62.1 | 63.1 | 65.0 | 70.0 |
| 600 | 41.0 | 41.6 | 42.0 | 42.0 | 42.0 | 42.0 | 42.0 | 42.0 | 42.0 | 42.0 | 43.0 | 44.0 | 46.5 | 48.4 | 51.7 | 59.4 | 59.9 | 63.1 | 63.1 | 64.0 | 64.0 | 65.0 | 66.9 | 70.0 | 70.0 |
| 800 | 41.0 | 41.6 | 42.0 | 42.0 | 42.5 | 42.5 | 42.5 | 42.5 | 42.5 | 43.0 | 44.0 | 44.0 | 47.5 | 50.2 | 53.6 | 59.3 | 59.8 | 63.1 | 63.1 | 64.0 | 65.0 | 66.0 | 66.9 | 70.0 | 70.0 |
| 1000 | 41.6 | 41.6 | 42.0 | 43.0 | 43.0 | 43.0 | 43.4 | 43.4 | 43.4 | 43.4 | 43.4 | 44.3 | 49.0 | 48.8 | 55.1 | 61.1 | 60.9 | 63.0 | 63.1 | 64.0 | 65.0 | 66.0 | 67.9 | 70.0 | 70.0 |
| 1200 | 41.6 | 41.6 | 42.0 | 43.0 | 43.0 | 43.0 | 43.7 | 44.0 | 44.4 | 46.0 | 46.0 | 46.9 | 49.3 | 51.1 | 55.3 | 61.2 | 60.4 | 62.7 | 63.1 | 63.1 | 66.0 | 67.9 | 67.9 | 70.0 | 71.0 |
| 1400 | 41.6 | 41.6 | 43.0 | 43.0 | 44.0 | 46.0 | 46.0 | 46.9 | 46.9 | 46.9 | 49.6 | 49.6 | 51.1 | 52.0 | 53.7 | 58.1 | 58.5 | 60.2 | 60.2 | 61.2 | 64.0 | 65.9 | 65.9 | 68.9 | 72.0 |
| 1600 | 42.5 | 42.5 | 43.0 | 43.0 | 45.0 | 46.9 | 48.7 | 49.6 | 49.6 | 49.6 | 49.6 | 50.5 | 52.0 | 52.9 | 54.2 | 54.8 | 56.6 | 58.0 | 58.4 | 61.1 | 63.9 | 64.8 | 65.7 | 67.7 | 73.0 |
| 1800 | 42.5 | 42.5 | 43.0 | 43.0 | 45.0 | 46.9 | 48.7 | 49.6 | 49.6 | 49.6 | 49.6 | 50.5 | 52.9 | 54.8 | 54.8 | 54.8 | 56.6 | 58.4 | 58.4 | 61.1 | 63.9 | 64.8 | 65.7 | 68.7 | 74.0 |
| 2000 | 42.5 | 42.5 | 43.0 | 43.0 | 46.0 | 46.9 | 49.6 | 50.5 | 51.3 | 51.3 | 51.3 | 51.3 | 52.9 | 54.8 | 54.8 | 54.8 | 58.0 | 59.3 | 59.3 | 61.1 | 63.9 | 64.8 | 65.7 | 68.7 | 74.0 |
| 2500 | 42.5 | 42.5 | 43.0 | 43.0 | 46.0 | 47.8 | 49.6 | 50.5 | 53.1 | 53.1 | 53.1 | 53.1 | 54.9 | 55.8 | 54.9 | 58.6 | 58.4 | 58.4 | 58.4 | 62.1 | 63.9 | 65.7 | 65.7 | 69.6 | 74.0 |
| 3000 | 42.5 | 43.0 | 43.0 | 43.0 | 48.7 | 48.7 | 50.5 | 52.2 | 54.9 | 54.9 | 55.8 | 55.8 | 55.8 | 55.8 | 55.8 | 57.8 | 56.7 | 58.4 | 57.2 | 63.2 | 63.9 | 65.7 | 66.6 | 69.6 | 75.0 |
| 3500 | 42.5 | 43.4 | 44.3 | 43.4 | 47.8 | 48.7 | 48.7 | 50.5 | 49.6 | 54.9 | 54.9 | 54.9 | 54.9 | 54.9 | 54.9 | 56.0 | 54.9 | 56.4 | 57.1 | 63.9 | 63.9 | 65.7 | 66.6 | 69.6 | 75.0 |
| 4000 | 42.5 | 43.4 | 44.2 | 44.3 | 48.7 | 48.7 | 48.7 | 49.6 | 49.6 | 49.6 | 49.6 | 49.6 | 50.5 | 50.5 | 52.9 | 55.5 | 55.3 | 56.0 | 57.2 | 63.9 | 63.9 | 66.6 | 66.6 | 69.6 | 74.0 |
| 4500 | 42.5 | 43.4 | 44.2 | 44.3 | 46.0 | 46.0 | 46.9 | 46.9 | 47.8 | 47.8 | 47.8 | 48.7 | 48.7 | 50.5 | 53.0 | 55.6 | 55.3 | 56.5 | 57.3 | 63.9 | 63.9 | 66.6 | 66.6 | 68.7 | 73.0 |
| 5000 | 42.5 | 43.4 | 44.2 | 44.3 | 44.3 | 44.2 | 44.2 | 44.2 | 44.2 | 44.3 | 44.3 | 44.3 | 45.1 | 46.0 | 53.1 | 55.7 | 55.5 | 57.3 | 57.5 | 63.9 | 63.9 | 65.7 | 65.7 | 68.7 | 73.0 |
| 5750 | 42.5 | 42.5 | 44.3 | 44.3 | 44.3 | 44.3 | 44.3 | 44.3 | 44.3 | 44.3 | 44.3 | 44.3 | 44.3 | 46.0 | 53.1 | 55.7 | 55.6 | 57.3 | 57.5 | 63.9 | 63.9 | 64.8 | 64.8 | 67.7 | 72.0 |
| 6500 | 41.6 | 41.6 | 41.6 | 41.6 | 41.6 | 41.6 | 41.6 | 41.6 | 41.6 | 41.6 | 41.6 | 41.6 | 45.1 | 46.0 | 53.1 | 55.8 | 55.7 | 57.5 | 57.5 | 63.9 | 63.0 | 63.9 | 63.9 | 65.9 | 71.0 |
| 7250 | 39.8 | 39.8 | 39.8 | 39.8 | 39.8 | 39.8 | 39.8 | 39.8 | 39.8 | 39.8 | 39.8 | 39.8 | 44.3 | 44.3 | 47.0 | 50.0 | 52.0 | 53.0 | 54.0 | 59.3 | 60.2 | 62.1 | 63.0 | 65.9 | 70.0 |
| 8000 | 39.8 | 39.8 | 39.8 | 39.8 | 39.8 | 39.8 | 39.8 | 39.8 | 39.8 | 39.8 | 39.8 | 39.8 | 42.0 | 42.0 | 46.0 | 48.0 | 49.0 | 50.0 | 48.7 | 54.8 | 59.3 | 61.1 | 62.1 | 65.9 | 70.0 |

204 244A 230A

FIG. 15

SELF-TUNING ELECTRONIC FUEL INJECTION SYSTEM

BACKGROUND OF THE INVENTION

1. Field of the Invention

This invention relates generally to fuel injection systems for internal combustion engines, and in particular to self-tuning fuel injection systems such as systems designed for aftermarket and high performance use.

2. Background Art

Fuel injection systems precisely meter fuel, thereby allowing optimal fuel-air mixture to be consistently delivered across the full spectrum of driving conditions. Fuel injection provides increased horsepower, higher torque, improved fuel economy, quicker cold starting, and other benefits as compared to older carburetion fuel delivery systems. Fuel injection systems use one or more fuel injectors, which are electromechanical devices that meter and atomize fuel. In each injector, application of an electrical current to a coil lifts a spring-loaded needle within a pintle valve off its seat, thereby allowing fuel under pressure to be sprayed through an injector nozzle to form a cone pattern of atomized fuel.

Electronic control is the most common manner for governing the rate of fuel injection. A microprocessor- or microcontroller-based computer system is included within an engine control unit (ECU). The computer controls fuel delivery by rapidly cycling on and off fuel injectors. The computer generates periodic pulse signals for each of the injectors, with "on" pulses for firing the fuel injectors. The duration of the "on" pulses determines fuel flow rate.

Fuel injector pulsing is controlled primarily as a function of engine speed, engine load, exhaust oxygen levels, and sometimes manifold air temperature (for air density compensation), coolant temperature (i.e., for simulating carburetor choke function) or throttle position (i.e., for simulating carburetor accelerator pump circuit operation). One or more driver circuits, which may be located within the ECU, amplify and condition the pulse signals to be suitable for use with the fuel injectors. The cycle wavelength is a function of engine speed, and the pulse widths of the "on" pulses are a function of engine load. Engine speed is typically determined by a distributor output, a tachometer output, or a crankshaft sensor. Engine load is typically determined with either a mass airflow sensor or a manifold absolute pressure (MAP) sensor.

Based on the engine speed and load input signals, the computer generates the fuel injector pulse signals. The fuel injector pulse signals are initially based on target air-fuel ratio values, which are compensated for the volumetric efficiency of the engine at its operating speed and load. Target air-fuel ratios and volumetric efficiency coefficients may be stored in one or more look-up tables in volatile or non-volatile computer memory and are accessed using engine load and speed as input indices. The use of look-up tables allows for rapid response by the ECU to various vehicle operating conditions without the need for extensive time-consuming calculations. Controlling the fuel injection directly from the look-up tables is referred to as open-loop control.

However, when the ECU operates in a closed-loop control mode, the actual fuel injector pulse signals may vary from those derived directly from the look-up tables based on actual engine operating conditions. In closed-loop control, the amount of oxygen present in the exhaust gas is measured, which provides an indication of whether the engine is running too rich, too lean, or stoichiometrically. The fuel rate supplied to the engine is corrected by the ECU based on the input from an oxygen sensor in an attempt to equate the actual air-fuel ratio to the stored target air-fuel ratio. Such closed-loop correction is sometimes referred to as short-term fuel trim, as the corrections are momentary in nature and are not stored.

In some ECU systems, one or more look-up tables may occasionally be updated based on the short-term fuel trim derived during closed-loop control. Such correction of the look-up tables is also referred to as long-term fuel trim. Because long-term corrections are made to the look-up tables stored in non-volatile memory, the duration of fuel injection is affected in both open-loop and closed-loop control modes for better overall fuel control.

Although short-term fuel trim is relatively responsive to rapid changes detected by the oxygen sensor, closed-loop control still involves an inherent feedback lag time. Additionally, although closed-loop control is ideal for cruising, idling, and light acceleration conditions, it is not suitable for use under all operating conditions. For example, only open-loop control is appropriate for use during wide-open throttle conditions, during hard acceleration, when starting the engine, or when the engine is cold. For these reasons, long-term fuel trim auto-tuning, which improves both open-loop and closed-loop operation, is desirable.

3. Identification of Objects of the Invention

A primary object of the invention is to provide a method and an electronic fuel injection control system that provides superior performance by intelligently applying long-term fuel trim corrections that minimize discontinuities in the look-up tables.

Another object of the invention is to provide a method and an electronic fuel injection control system that provides superior performance by correcting discontinuities in the look-up tables independently of long-term fuel trim corrections.

SUMMARY OF THE INVENTION

The objects described above and other advantages and features of the invention are incorporated in an electronic fuel injection system and method that is designed and arranged to self-tune and optimize look-up tables during operation.

A computer processor controls various engine and automotive systems as preprogrammed functions of numerous signals received from various sensors. The processor executes algorithms for controlling the fuel injector pulsing so as to maintain optimal air/fuel ratios. In a preferred embodiment, target air/fuel ratio data and volumetric efficiency data are stored in computer memory in the form of a look-up table as a function of engine speed and load for controlling fuel injector pulsing. An operating zone of four cells within the look-up table is used to compute the value at the operating point by linear interpolation.

In an open-loop control mode, an airflow estimator algorithm determines the mass air flow rate into the engine from an engine speed signal and a manifold absolute pressure signal according to the engine's volumetric efficiency factors. A fuel pulse generation algorithm calculates from the computed or measured mass air flow rate and the target air/fuel ratio table the fuel injection pulse width and frequency required to add the required fuel mass to achieve the target air/fuel ratio for that engine speed and load. The computer generates one or more corresponding periodic waveforms to actuate the fuel injectors. In a closed-loop control mode, in addition to the operational inputs associated with the open-loop control, the fuel pulse generation algorithm may also receive an input signal that indicates the concentration of oxygen in the exhaust, from which the actual air/fuel mixture is determined.

A long-term fuel trim correction algorithm is executed by the processor, which selectively replaces an operating zone the volumetric efficiency table based with a proposed correction zone based on closed-loop control to achieve the target air/fuel ratio. The proposed correction zone is written to the look-up table only if one or more mathematical checks determines that the correction does not result in an abrupt discontinuity in the look-up table. A determinative zone of cells surrounding the operating zone is compared to the proposed correction zone using one or more various techniques.

According to a first technique, for each cell in the proposed correction zone, the absolute value of the difference of the proposed cell and the arithmetic mean of the eight cells immediately surrounding the proposed cell is calculated. If any one of the results is greater than a predetermined maximum average set point, then, no correction is applied to the look-up table.

According to a second technique, for each of the cells in the proposed correction zone, the standard deviation of the proposed cell with its eight neighboring cells is calculated. If the any one of results is less than a predetermined maximum deviation set point, then, no correction is applied to the look-up table.

According to a third technique, for each of the cells in the proposed correction zone, the absolute value of the percent difference between the proposed cell and each of its eight neighboring cells is calculated. If any one of the results is greater than a predetermined maximum percent difference set point, then no correction is applied to the look-up table.

According to a fourth technique, for each of the cells in the proposed correction zone, the absolute value of the difference between the proposed cell and each of its neighboring cells is calculated. If any one of the results is greater than a predetermined maximum absolute difference set point, then no correction is applied to the look-up table.

According to a preferred embodiment, all four of the calculation techniques are used. However, other combinations are possible. By calculating these relations between the values of the proposed zone and the values of the determinative zone, it can be determined whether the proposed correction would create abrupt discontinuities in the volumetric efficiency table that might be noticed by the user during operation of engine. If so, the processor does not make the proposed change.

According to an embodiment of the invention, a repair algorithm may be executed by the processor, in addition to, or in lieu of, the long-term fuel trim correction algorithm. The repair algorithm may be executed in series either before or after the correction algorithm, it may be executed in parallel or independently. In contrast to the correction algorithm, which simply inhibits the long-term fuel trim corrections of the proposed correction zone from being written to the look-up table, the repair algorithm is a real-time smoothing algorithm with the ability to make corrections to the table outside of the operating zone.

The repair algorithm functions by first defining a repair zone that surrounds the operating zone. The engine operating point acts as a moving cursor that defines the operating zone and repair zone at any moment in time. Once a repair zone is defined, the repair algorithm identifies whether any value within the repair zone has such a dissimilar magnitude as compared to its neighbors as to possibly cause poor engine performance. If so, the algorithm causes the processor to correct offending values using a common linear interpolation scheme, such as Nearest Neighbor Interpolation. In this manner, the repair algorithm smoothes out data within the look-up table while the engine operates to provide for better fuel injection operation.

BRIEF DESCRIPTION OF THE DRAWINGS

The invention is described in detail hereinafter on the basis of the embodiments represented in the accompanying figures, in which:

FIG. 2 is an exemplary volumetric efficiency table characteristic of a typical internal combustion engine for use with the engine control unit of FIG. 1;

FIG. 3 is a proposed modification of the volumetric efficiency table of FIG. 2 according to the engine control unit of FIG. 1, showing a proposed correction zone and a surrounding determinative zone according to a preferred embodiment of the invention;

FIG. 5 is an excerpt of the proposed volumetric efficiency table of FIG. 3, showing the proposed correction zone and surrounding determinative zone repeated in four permutations to illustrate a first set of corrections based on arithmetic mean calculations according to the volumetric efficiency correction algorithm of FIG. 4;

FIG. 6 is an excerpt of the proposed volumetric efficiency table of FIG. 3, showing the proposed correction zone and surrounding determinative zone repeated in four permutations to illustrate a second set of corrections based on standard deviation calculations according to the volumetric efficiency correction algorithm of FIG. 4;

FIG. 7 is an excerpt of the proposed volumetric efficiency table of FIG. 3, showing the proposed correction zone and surrounding determinative zone repeated in thirty-two permutations to illustrate a third set of corrections based on percent difference calculations according to the volumetric efficiency correction algorithm of FIG. 4;

FIG. 8 is an excerpt of the proposed volumetric efficiency table of FIG. 3, showing the proposed correction zone and surrounding determinative zone repeated in twenty-six permutations to illustrate a fourth set of corrections based on absolute difference calculations according to the volumetric efficiency correction algorithm of FIG. 4;

FIG. 10 is a copy of the exemplary volumetric efficiency table of FIG. 2 depicting two scenarios in which the engine transitions from a lower speed, lower load operation to a higher speed higher load operation to illustrate the repair algorithm of FIG. 9;

FIG. 11 is a copy of the exemplary volumetric efficiency table depicting the first scenario of FIG. 10, showing blocks of cells used for interpolating values from the table during the scenario;

FIG. 12 is a copy of the exemplary volumetric efficiency table depicting the second scenario of FIG. 10, showing blocks of cells used for interpolating values from the table during the scenario;

FIG. 14 is a copy of the exemplary volumetric efficiency table of FIG. 11, showing an operating zone and a repair zone according to the repair algorithm of FIG. 9 for an engine operating at a point midway in the scenario; and FIG. 15 is a copy of the exemplary volumetric efficiency table of FIG. 11, showing the blocks of cells that have been included within the repair zone at some point during the scenario.

DESCRIPTION OF THE PREFERRED EMBODIMENT OF THE INVENTION

Figure 1:
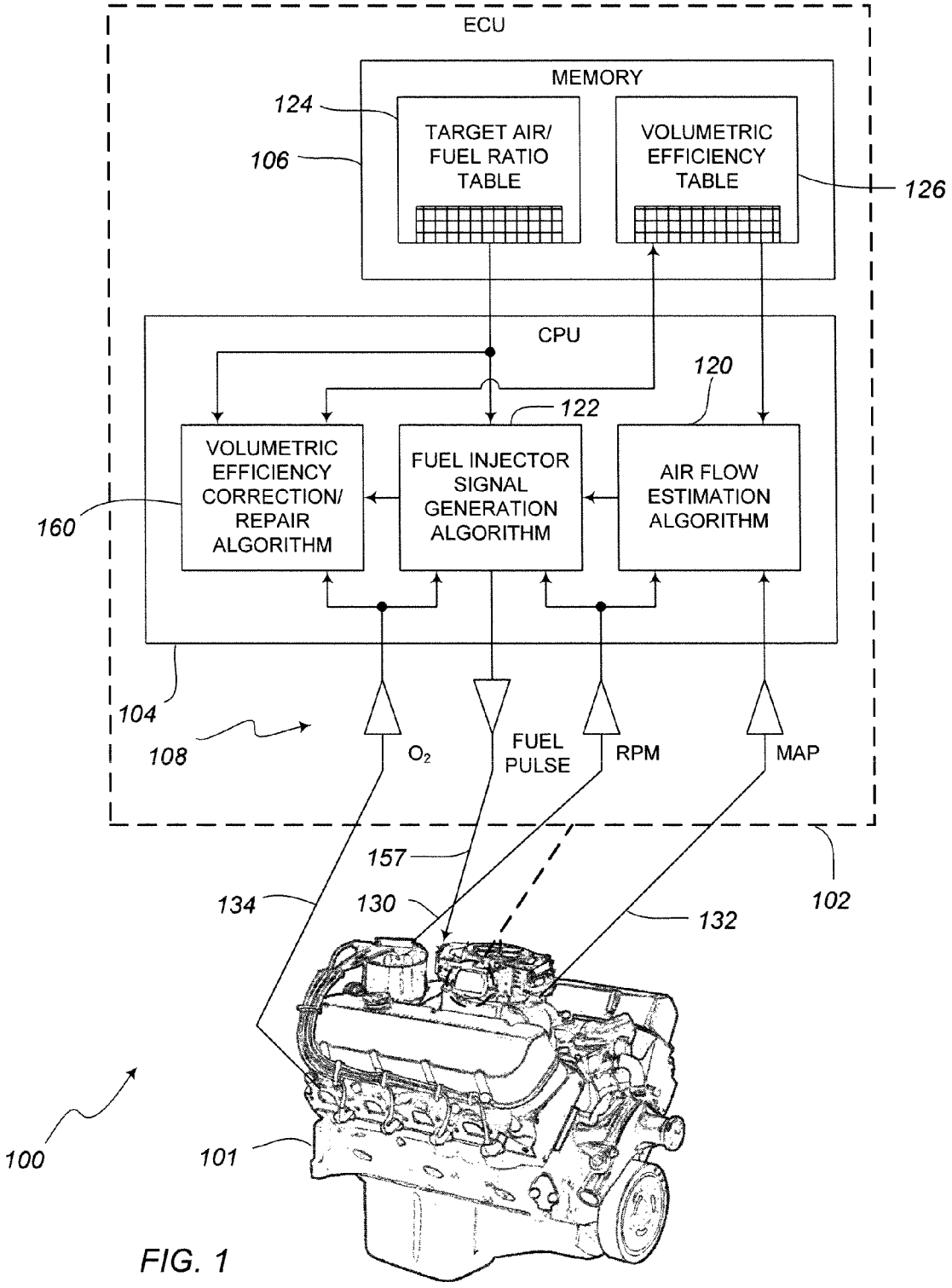
FIG. 1 is a block level schematic diagram of an engine control unit of a self-tuning electronic fuel injection system according to a preferred embodiment of the invention.

FIG. 1 illustrates an electronic fuel injection system 100 according to a preferred embodiment of the invention. A computer processor 104, such as a microprocessor or microcontroller (sometimes known as a central processing unit, or CPU), is included within ECU 102. The computer processor 104 controls various engine and automotive systems as preprogrammed functions of numerous signals received from various sensors. Computer memory 106, which may include both random access memory (RAM) and non-volatile memory such as Flash memory or electrically erasable programmable read-only memory (EEPROM), is in electrical communication with computer processor 104 as is well known to those of ordinary skill in the art of computer system design. Discrete electronic components may be combined in an application-specific integrated circuit (ASIC) as appropriate.

Processor 104 executes algorithms 120, 122 for controlling the fuel injector pulsing so as to maintain optimal air/fuel ratios. Target air/fuel ratio data 124 and volumetric efficiency data 126, both as a function of engine speed and load, are stored in memory 106. Fuel injector pulsing is controlled by algorithms 120, 122 primarily as a function of engine speed 130 and engine load 132 (e.g., MAP or mass air flow), as is known in the art. Other inputs including exhaust oxygen concentration or air/fuel ratio 134, manifold air temperature (not illustrated), coolant temperature (not illustrated), and throttle position (not illustrated), may be used, depending on specific control system topology. The fuel pulse width output signal 157 is thereafter formatted and conditioned for actuating fuel injectors as appropriate. Various input/output buffer and driver electronic circuitry, shown generally at 108, is provided in ECU 102 as is appropriate.

In an open-loop control mode, an airflow estimator algorithm 120 determines the mass air flow rate into the engine from an engine speed signal 130 and a manifold absolute pressure signal 132 according to the engine's volumetric efficiency factors 126. Other inputs (not illustrated), such as induction air temperature in the engine's intake manifold and barometric pressure may be used to more accurately determine mass air flow, as is known to routineers of ordinary skill in the art. Alternatively, a mass air flow sensor may be used for a more direct measurement of air flow.

Next, a fuel pulse generation algorithm 122 calculates from the computed or measured mass air flow rate and the target air/fuel ratio table 124 the fuel injection pulse width and frequency required to add the required fuel mass to achieve the target air/fuel ratio for that engine speed and load. The computer 104 generates one or more corresponding periodic waveforms 157 to actuate the fuel injectors.

In a closed-loop control mode, in addition to the operational inputs associated with the open-loop control described above, the fuel pulse generation algorithm 122 may also receive an input signal 134 that indicates the concentration of oxygen in the exhaust, from which the actual air/fuel mixture is determined. Preferably, a wide-band oxygen sensor, also known as an air/fuel ratio sensor, is used, which provides an output signal relatively proportional to air/fuel ratios between 12 and 19. However, an older-style narrow-band oxygen sensor may be used in the alternative. The fuel pulse generation algorithm 122 will alter the fuel pulse signals 157 so that the actual air/fuel ratio meets the target air/fuel ratio, as is known to those of ordinary skill in the art as short-term fuel trim.

According to a preferred embodiment of the invention, a long-teen fuel trim correction algorithm 160 is executed by processor 104, which selectively updates the volumetric efficiency table 126 based on the closed-loop short-term fuel trim corrections necessary to achieve the target air/fuel ratio. Correction of the volumetric efficiency table 126 ensures that future open-loop control will be more accurate, thereby more quickly approaching the target air/fuel ratios with less short-term fuel trim correction required during closed-loop control.

FIG. 2 illustrates a typical volumetric efficiency table 126. Table 126 includes a header row 200, a header column 202, and plurality of cells 204, with each cell being characterized by a unique column and row combination. Each of the cells 204 within a particular column includes a volumetric efficiency percentage value that pertains to the manifold absolute pressure value indicated within the cell in the header row 200. Similarly, each of the cells 204 within a particular row includes a volumetric efficiency percentage value that pertains to the engine speed value indicated within the cell in the header column 202. A hashed line border 206 and the absence of shading demark the region 208 of table 126 that characterizers normal use of a naturally aspirated engine from the lightly shaded region 210 that denotes abnormal use.

Because engine 101 (FIG. 1) operates over a continuously variable range of speeds and loads but volumetric efficiency table 126 is limited to a small number of discrete values, the mass air flow is seldom obtainable directly from the table. Accordingly, an operating zone 212 of four cells 204 is used to compute the value at the operating point. To estimate the engine mass airflow at a given speed $\omega_j$ and load $L_b$, ECU 102 interpolates the percent volumetric efficiency from the closest values contained volumetric efficiency table 126 using values at the next slower and faster speeds, $\omega_i$ and $\omega_k$, respectively, and the next lesser and greater loads, $L_a$ and $L_c$, respectively. The following linear interpolation formula may be used:

$$V_{b,j} = \left[\frac{(L_b - L_a)}{(L_c - L_a)}(V_{c,k} - V_{a,k} - V_{c,i} + V_{a,i}) + V_{a,k} - V_{a,i}\right] \frac{(\omega_j - \omega_i)}{(\omega_k - \omega_i)} + \frac{(L_b - L_a)}{(L_c - L_a)}(V_{c,i} - V_{a,i}) + V_{a,i} \quad \text{(Eq. 1)}$$

where $V_{b,j}$ is the percent volume efficiency at manifold absolute pressure $L_b$ and engine speed $\omega_j$, et cetera. As linear interpolation is well known to those of ordinary skill in the art, it is not discussed further herein.

In a first exemplary scenario, an engine 101 outfitted with fuel injection system 100 (FIG. 1) is operating at a manifold absolute pressure of 67 kPa and at a speed of 2400 rpm. ECU 102 linearly interpolates the percent volumetric efficiency to be 53.4 from the shaded four-cell-block operating zone 212 according to Equation 1, above.

Say, for example, that during extended operation at 67 kPa and 2400 rpm, ECU 102 determines from the air/fuel ratio sensor signal 134 that the air/fuel ratio based on the volumetric efficiency of 53.4 is too rich and that a four percent long-term fuel trim reduction is appropriate. According to one embodiment of the invention, volumetric efficiency correction algorithm 160 (FIG. 1) includes a table correction algorithm that causes ECU 102 to determine whether to update the four-cell operating zone 212 (shown with shading in FIG. 2) of table 126 based on whether the proposed corrections would create a discontinuity or an abrupt step change with respect to the bordering cells.

FIG. 3 illustrates proposed volumetric efficiency table 126', which is identical to table 126 of FIG. 2 except that operating zone 212 is replaced with a four-cell proposed correction zone 222 (shown with inverse print) having values that are an exemplar four percent smaller. The twelve cells 224 that border proposed correction zone 222 (shown with shading) are termed the determinative zone. The determinative zone 224 is compared to the proposed correction zone 222, as described in greater detail below, to ensure that the proposed corrected does not create a non-linearity in table 126 of such a magnitude as to cause undesirable engine behavior. If the proposed correction does create an undesirable anomaly, then the proposed corrections are not written to table 126.

Figure 4:
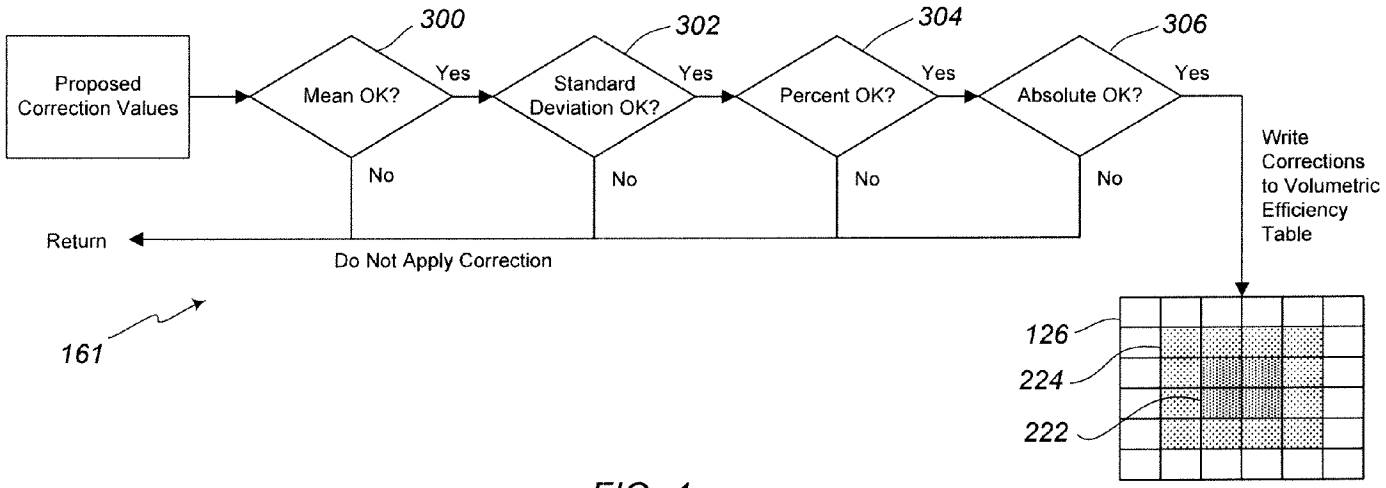
FIG. 4 is flowchart diagram of a volumetric efficiency correction algorithm implemented by the engine control unit of FIG. 1 with respect to the proposed volumetric efficiency table of FIG. 3 according to a preferred embodiment of the invention.

FIG. 4 illustrates a flow chart diagram for a table correction algorithm 161 of volumetric efficiency correction/repair algorithm 160, by which ECU 102 determines whether to update volumetric efficiency table 126 (FIGS. 1-2) with a long-term fuel trim correction based on whether the correction would induce a significant non-linearity in table 126. At step 300, for each of the four cells 204 in the proposed correction zone 222 of proposed volumetric efficiency table 126' (FIG. 3), ECU 102 determines whether the absolute value of the difference of the proposed cell and the arithmetic mean of the eight cells immediately surrounding the proposed cell is less than a predetermined maximum difference value, called the maximum average set point. If each of the four calculated differences is less than the maximum average set point, then step 302 is performed. Otherwise, no correction is applied to table 162.

Similarly, at step 302, for each of the four cells 204 in the proposed correction zone 222 of proposed volumetric efficiency table 126' (FIG. 3), ECU 102 determines whether the standard deviation of the proposed cell in question with its eight neighboring cells is less than a predetermined maximum deviation set point. If each of the four calculated standard deviations is less than the maximum deviation set point, then step 304 is performed. Otherwise, no correction is applied to table 162.

At step 304, for each of the four cells 204 in the proposed correction zone 222 of proposed volumetric efficiency table 126' (FIG. 3), ECU 102 determines the absolute value of the percent difference between the proposed cell in question and each of its eight neighboring cells. If all thirty-two of the calculated percent difference values are less than a predetermined maximum percent difference set point, then step 306 is performed. Otherwise, no correction is applied to table 162.

Finally, at step 306, for each of the four cells 204 in the proposed correction zone 222 of proposed volumetric efficiency table 126' (FIG. 3), ECU 102 determines the absolute value of the difference between the proposed cell in question and each of its neighboring cells. If all twenty-six of the calculated difference values are less than a predetermined maximum absolute difference set point, then the original volumetric efficiency values 212 are overwritten with the values of proposed correction zone 222 by ECU 102. Otherwise, no correction is applied to table 162.

By calculating these relations between the values of the proposed zone 222 and the values of the determinative zone 224 (FIG. 3), it can be determined whether the proposed correction would create abrupt discontinuities in the volumetric efficiency table 126 that might be noticed by the user during operation of engine 101 (FIGS. 1 and 2). If so, ECU 102 does not make the proposed change. Although the flow chart of FIG. 4 shows the arithmetic mean, standard deviation, percent difference, and absolute difference calculations 300, 302, 304, 306, respectively, to be performed in a particular order, the calculations may actually be performed in any order according to the invention. Further, not every check is required. Any one or more of the steps 300, 302, 304, 306 alone or in combination may be used in algorithm 160 according to the invention.

FIG. 5 illustrates the arithmetic mean calculation step 300 of FIG. 4 in greater detail. FIG. 5 shows the four permutations of each of the four individual proposed correction zone cells 230 (shown in inverted print) with its eight neighboring cells 232 (shown with shading). For each of the four cells 204 in the proposed correction zone 222 of proposed volumetric efficiency table 126' (FIG. 3), ECU 102 determines whether the absolute value of the arithmetic mean of the eight cells surrounding proposed cell in question, less the value of the proposed cell, is less than a predetermined maximum difference value, called the maximum average set point. That is, for each of the four illustrated variants, ECU evaluates the following condition:

$$\text{if } (|\overline{\text{cells232}} - \text{cell } 230| < \text{MAX}_{AVG}), \text{ then TRUE, else FALSE} \quad \text{(Eq. 2)}$$

If each of the four calculated differences is less than the maximum average set point, then step 302 of algorithm 160 (FIG. 4) is performed. Otherwise, no correction is applied to table 162 (FIGS. 1 and 2). Using the exemplar permutations of FIG. 5, the calculated values are, from left to right and then top to bottom, 2.29, 1.91, 2.06, and 0.93. Accordingly, a $\text{MAX}_{AVG}$ set point of 2.50 would allow advancement to step 302, but a $\text{MAX}_{AVG}$ set point of 2.25 would prevent the proposed long-term fuel trim correction to table 126.

Similarly, FIG. 6 illustrates the standard deviation calculation step 302 of FIG. 4 in greater detail. FIG. 6 shows the proposed correction zone 222 and determinative zone 224 of proposed volumetric efficiency table 126' (FIG. 3), with four combinations 240 of nine-cell, 3×3 contiguous blocks, indicated by shading. Each of the four blocks 240 is an aggregation of one of the four cells 204 in proposed correction zone 222 with its eight immediate neighboring cells, of which five are located in the determinative zone 224 and three in the proposed correction zone 222. For each of the four combinations 240, the standard deviation is calculated by ECU 102 and compared with a predetermined maximum standard deviation value, called the maximum deviation set point, according to the following equation:

$$\text{if}(\sigma_{cells\ 240} < \text{MAX}_{\sigma}), \text{ then TRUE, else FALSE} \quad \text{(Eq. 3)}$$

If each of the four calculated standard deviations is less than the maximum deviation set point, then step 304 of algorithm 160 (FIG. 4) is performed. Otherwise, no correction is applied to table 162 (FIGS. 1 and 2). Using the exemplar combinations of FIG. 6, the calculated values are, from left to right and then top to bottom, 1.41, 2.28, 2.49, and 2.63. Accordingly, a $MAX_{\sigma}$ set point of 2.75 would allow advancement to step 304, but a $MAX_{\sigma}$ set point of 2.50 would prevent the proposed long-term fuel trim correction to table 126.

FIG. 7 illustrates the percent difference calculation step 304 of FIG. 4 in greater detail. FIG. 7 shows the proposed correction zone 222 and determinative zone 224 of proposed volumetric efficiency table 126' (FIG. 3), with the thirty-two permutations of each of the four individual proposed correction zone cells 250 (shown in inverted print) with one of its eight neighboring cells 252 (shown with shading). For each of the thirty-two permutations, the absolute value of the percent difference is calculated by ECU 102 and compared with a predetermined maximum percent difference value, called the maximum percent difference set point, according to the following equation:

$$\text{if}(|(\text{cell } 252-\text{cell } 250)/\text{cell } 250|<MAX_{\Delta\%}),\ \text{then TRUE, else FALSE} \quad \text{(Eq. 4)}$$

If each of the thirty-two calculated percent difference values is less than the maximum percent difference set point, then step 306 of algorithm 160 (FIG. 4) is performed. Otherwise, no correction is applied to table 162 (FIGS. 1 and 2). Using the exemplar combinations of FIG. 7, the calculated values range from a minimum of 0.39% to 9.84%. Accordingly, a $MAX_{\Delta\%}$, set point of 10% would allow advancement to step 304, but a $MAX_{\Delta\%}$ set point of 9% would prevent the proposed long-term fuel trim correction to table 126.

Finally, FIG. 8 illustrates the absolute difference calculation step 306 of FIG. 4 in greater detail. FIG. 8 shows the proposed correction zone 222 and determinative zone 224 of proposed volumetric efficiency table 126' (FIG. 3), with the twenty-six combinations of each of the four individual proposed correction zone cells 260 (shown in inverted print) with one of its eight neighboring cells 262 (shown with shading). For each of the twenty-six combinations, the absolute value of the difference is calculated by ECU 102 and compared with a predetermined maximum absolute difference value, called the maximum absolute difference set point, according to the following equation:

$$\text{if}(|(\text{cell } 262-\text{cell } 260)|<MAX_{\Delta}),\ \text{then TRUE, else FALSE} \quad \text{(Eq. 5)}$$

If each of the twenty-six calculated absolute difference values is less than the maximum absolute difference set point, then the original volumetric efficiency values 212 are overwritten with the values of proposed correction zone 222 by ECU 102. Otherwise, no correction is applied to table 162 (FIGS. 1 and 2). Using the exemplar combinations of FIG. 8, the calculated values range from a minimum of 0.2 to 5.0. Accordingly, a $MAX_{\Delta}$ set point of 6.0 would allow the proposed correction to be written to table 126, but a $MAX_{\Delta}$ set point of 5.0 would prevent the proposed long-term fuel trim correction to table 126.

Figure 9:
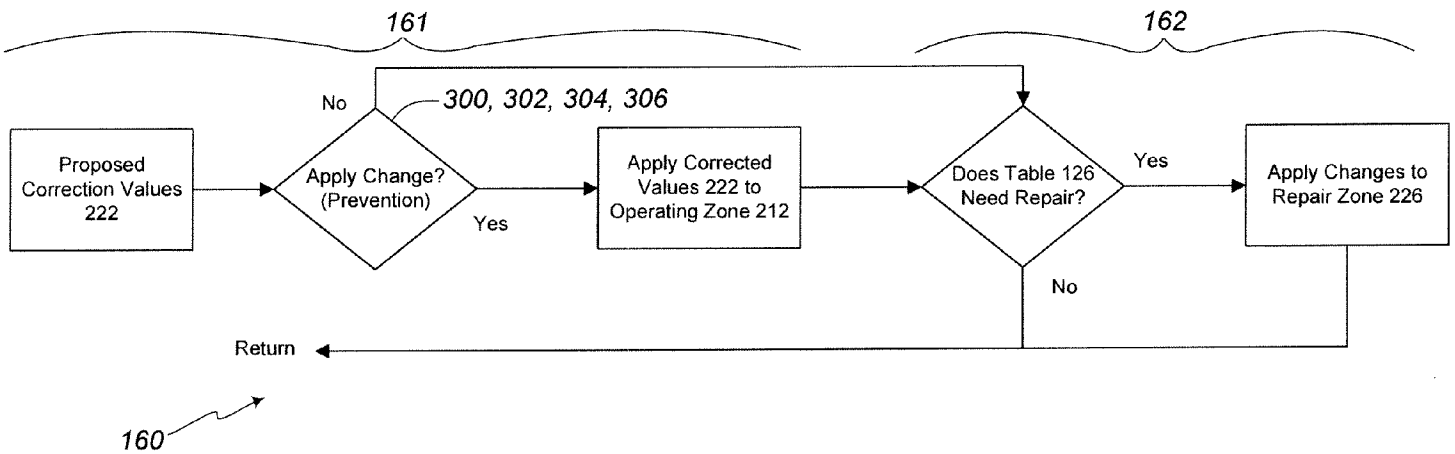
FIG. 9 is simplified flowchart diagram of an overall volumetric efficiency correction and repair algorithm implemented by the engine control unit of FIG. 1 with respect to the volumetric efficiency table of FIG. 2 or 3.

FIG. 9 is a flow chart diagram of the volumetric efficiency correction/repair algorithm 160 of FIG. 1, showing the correction algorithm 161 of FIG. 4 coupled with an optional repair algorithm 162. Although repair algorithm 162 is shown as occurring in series after correction algorithm 161, it may occur before, or the two algorithms may occur in parallel or independently. In contrast to correction algorithm 161, which simply inhibits the long-term fuel trim corrections of proposed correction zone 222 (FIG. 3) from being written to the table, repair algorithm 162 is a real-time smoothing algorithm with the ability to make corrections to table 126 outside of operating zone 212 (FIG. 2).

FIG. 10 depicts exemplar uphill climb operation of engine 101 (FIG. 1) for the purpose of illustrating the operation of repair algorithm 162. In a first scenario, depicted by arrow 230A, which is superimposed over table 126 so as to indicate operating parameters, the engine 101 transitions from operating at about 2600 rpm, 69.5 kPa to about 4150 rpm, 88 kPa. The operating zone during the initial level cruise condition is shown at 212*a* by shaded cells, and the final operating zone after downshifting and while climbing is shown at 212*c* by shaded cells. A second scenario, which is similarly depicted by arrow 230B, shares the same initial and final operating zones 212*a*, 212*c*, respectively. However, in the second scenario, the engine 101 (FIG. 1) transitions from operating at about 2900 rpm, 66 kPa to about 4450 rpm, 85.2 kPa.

Figure 13:
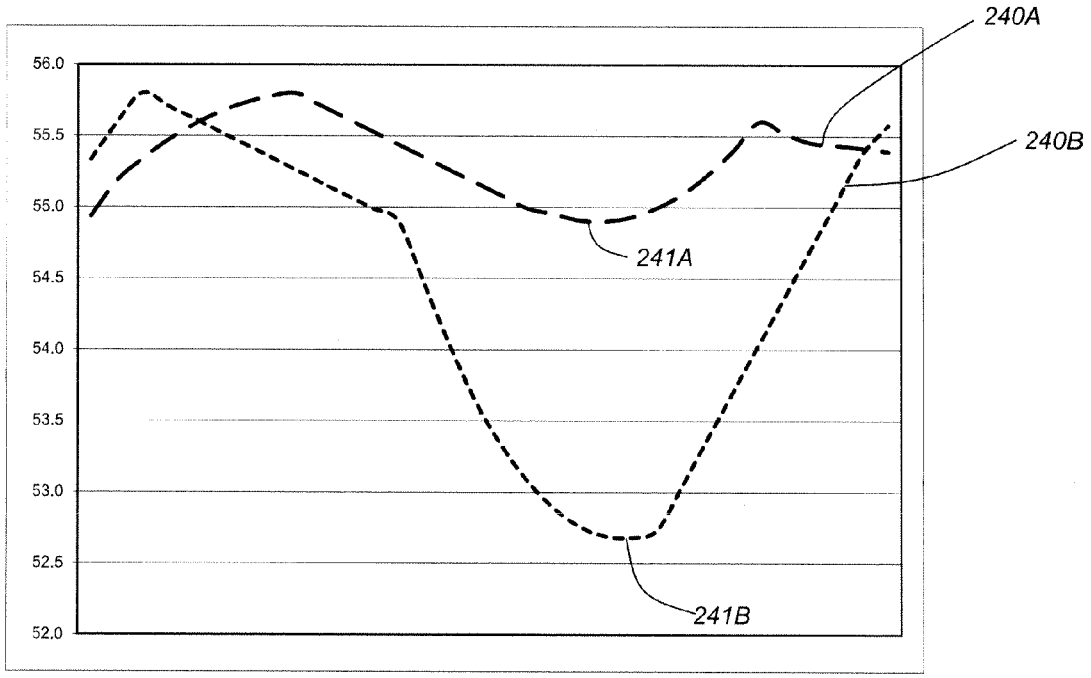
FIG. 13 is a graph of values interpolated from the volumetric efficiency table for the two scenarios of FIGS. 10-12.

FIGS. 11 and 12 illustrate the first and second scenarios, respectively, of FIG. 10. As the engine 101 transitions from cruise to uphill climb, the four-cell operating zones shift along arrows 230A, 230B from position 212*a* to 212*c* (FIG. 10) to define, in the aggregate, blocks of cells 238A, 238B (shown with shading) who's values are used for interpolating values from table 126 for engine operation during this period of time. The interpolated values, according to Equation 1 above, for the first and second scenarios 230A, 230B are plotted as curves 240A, 240B, respectively, in the chart of FIG. 13.

Although arrows 230A and 230B are similar, the operating curve 240B has a significantly pronounced dip 241B that is absent from operating curve 240A. Operating curve 240A has a small dip 241A with a value equal to the initial cruise value. In contrast, dip 241B is much less than either the initial cruise value or the final climb value. This anomaly stems from the fact that three cells 204 having a low value of 50.5 are included in block of cells 238B (FIG. 12) used for interpolation for the second scenario that not included in block 238A for the first scenario. Dip 241B may be significant enough to cause a detectable loss of engine performance during the transition.

Accordingly, repair algorithm 162 (FIG. 9) functions by first defining a current repair zone 226 that surrounds each current operating zone 212. For example, as shown in FIG. 10, repair zone 226*a* includes twelve cells 204 that surround the cruise operating point 212*a*, and repair zone 226*c* includes the twelve cells 204 surround the climb operating point 212*c*. That is, the operating point 212 acts as a moving cursor that defines the repair zone 226 at any moment in time. Once a repair zone 226 is defined, algorithm 162 identifies whether any value within repair zone 226 has such a dissimilar magnitude as compared to its neighbors as to possibly cause poor engine performance. If so, algorithm 162 causes ECU 102 to correct offending values using a common linear interpolation scheme, such as Nearest Neighbor Interpolation. As such mathematical operations are known in the art, they are not discussed in further detail herein.

Returning back to the first exemplar transition-to-climb scenario, FIG. 14 illustrates the operating zone 212*b* and associated repair zone 226*b* when engine 101 is operating at 69.5 kPa and 3025 rpm. As can be seen, two of the low, 50.5 values that caused dip 241B are included within repair zone 226*b*. Algorithm 162 can evaluate repair zone 226*b* and determine that the 50.5 values are too low as compared to the neighboring 54.9 values in operating zone 212*b* and repair the offending values by interpolation using the neighboring values above and below, for example. Indeed, as shown in FIG. 15, the complete collection of cells 204 that are at one time or another contained within repair zone 226 during the engine transition defined by arrow 230A, which is indicated by shading at 244A, includes all three of the cells with the low 50.5 values. In this manner, algorithm 162 smoothes out data within table 162 while the engine operates to provide for better fuel injection operation.

The preferred embodiments described above all illustrate operation of the electronic fuel injection system 100 in terms of a four-cell operating zone 212, which is based on engine operation at a point that does not have exact corresponding entries on the look-up table 126. Of course, it is possible that either the load or engine speed value has a matching entry in table 126. In this case, a simple linear interpolation using a two-cell operating zone is all that is required. Equally, if both the engine load and speed have corresponding values in table 126, than a one-cell operating zone is used, and no interpolation is required to determine the volumetric efficiency, for example. In either of these cases, the correction and repair algorithms 161, 162 operate substantially the same as with a four-cell zone, except that the number of cells 204 involved in the mathematical computations is less.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A control system for a fuel-injected internal combustion engine, comprising:

a computer processor;

a memory operatively coupled to said computer processor;

data stored in said memory, said data including a plurality of numerical values approximately proportional to volumetric efficiency of said engine at a plurality of discrete engine speeds and a plurality of discrete engine loads, each of said numerical values being associated with one of said plurality of discrete engine speeds and one of said plurality of discrete engine loads;

electronic circuitry connected to said computer processor for coupling said computer processor to an engine load sensor, an engine speed sensor, an exhaust sensor, and a fuel injector;

a first algorithm stored in said memory and structured for execution by said computer processor to determine an engine speed from said engine speed sensor and an engine load from said engine load sensor and, based on said data and a target air-fuel ratio, to generate an output signal so as to cause said fuel injector to introduce fuel to said engine at an appropriate flow rate for said engine speed and said engine load;

a second algorithm stored in said memory and structured for execution by said computer processor to compare said target air-fuel ratio to an actual air-fuel ratio that is determined using said exhaust sensor and, if said actual air-fuel ratio differs from said target air-fuel ratio by more than a predetermined amount, to propose a corrected value to be used in place of a first of said plurality of numerical values; and a third algorithm stored in said memory and structured for execution by said computer processor, said third algorithm being one from the group consisting of a correction algorithm and a repair algorithm; wherein said correction algorithm is structured to replace said first of said plurality of numerical values with said corrected value if the result of one or more calculations is less than one or more predetermined set points; wherein the one or more calculations includes at least one from the group consisting of an absolute value of a difference between said corrected value and a second of said plurality of numerical values, an absolute value of a percent difference between said corrected value and said second of said plurality of numerical values, an absolute value of the difference between said corrected value and an arithmetic mean at least said second and a third of said plurality of numerical values, and a standard deviation of said corrected value and at least said second and said third of said plurality of numerical values; wherein said repair algorithm is structured to replace said second of said plurality of numerical values with a repair value if said second of said plurality of numerical values differs significantly from said first of said plurality of numerical values; and wherein said first algorithm will generate an output signal so as to cause said fuel injector to introduce fuel to said engine at an appropriate flow rate for said engine speed and said engine load based on said corrected value or said second of said plurality of numerical values, and said target air-fuel ratio.

2. The control system of claim 1, wherein:

said third algorithm is said correction algorithm; and said one or more calculations includes all of the group consisting of an absolute value of a difference between said corrected value and said second of said plurality of numerical values, an absolute value of a percent difference between said corrected value and said second of said plurality of numerical values, an absolute value of the difference between said corrected value and an arithmetic mean at least said second and said third of said plurality of numerical values, and a standard deviation of said corrected value and at least said second and said third of said plurality of numerical values.

3. The control system of claim 1, wherein:

said plurality of values include at least sixteen values forming a contiguous 4×4 array associated with discrete first, second, third, and fourth engine speeds and discrete first, second, third, and fourth engine loads.

4. The control system of claim 3, wherein:

said first of said plurality of numerical values is associated with said second engine speed and said second engine load and defines a surrounding zone of eight of said plurality of numerical values associated with said first engine speed and said first engine load, said first engine speed and said second engine load, said first engine speed and said third engine load, said second engine speed and said first engine load, said second engine speed and said third engine load, said third engine speed and said first engine load, said third engine speed and said second engine load, and said third engine speed and said third engine load; and said second and said third of said plurality of numerical values are two of said eight of said plurality of numerical values of said surrounding zone.

5. The control system of claim 4, wherein:

said third algorithm is said correction algorithm; and said one or more calculations includes an absolute value of a difference between said corrected value and each of said eight of said plurality of numerical values of said surrounding zone.

6. The control system of claim 4, wherein:

said third algorithm is said correction algorithm; and said one or more calculations includes an absolute value of a percent difference between said corrected value and each of said eight of said plurality of numerical values of said surrounding zone.

7. The control system of claim 4, wherein:

said third algorithm is said correction algorithm; and said one or more calculations includes an absolute value of a difference between said corrected value and an arithmetic mean of all of said eight of said plurality of numerical values of said surrounding zone.

8. The control system of claim 4, wherein:

said third algorithm is said correction algorithm; and said one or more calculations includes a standard deviation of said corrected value and all of said eight of said plurality of numerical values of said surrounding zone.

9. The control system of claim 4, wherein:

said third algorithm is said repair algorithm; and said a repair value is calculated by interpolation between said first of said plurality of numerical values and a fourth of said plurality of numerical values, wherein said fourth of said plurality of numerical values falls outside of and adjacent to said surrounding zone.

10. The control system of claim 1, further comprising:

a fourth algorithm stored in said memory and structured for execution by said computer processor; wherein said third algorithm is said correction algorithm; and said fourth algorithm is said repair algorithm.

11. The control system of claim 10, wherein:

said third and said a fourth algorithms are executed by said computer processor in series.

12. The control system of claim 10, wherein:

said third and said a fourth algorithms are executed by said computer processor in parallel.

13. In an engine control system including a processor, a memory, and a look-up table stored in said memory upon which fuel injection control is based at least in part, wherein the control system is designed and arranged to perform a long-term fuel trim correction to said look-up table based on closed-loop control, the improvement comprising:

a first algorithm structured for execution by said processor that prevents a proposed long-term fuel trim correction from being written to said look-up table if said proposed long-term fuel trim correction would create a discontinuity within said look-up table greater than a first predetermined maximum based on a mathematical comparison of one or more corrected values of said look-up table and one or more neighboring values in said look-up table.

14. The engine control system of claim 13 wherein the improvement further comprises:

a second algorithm structured for execution by said processor that identifies a first value in said look-up table in a zone that surrounds a second value in said look-up table that is associated with current engine speed and load; and a third algorithm structured for execution by said processor that determines whether a mathematical discontinuity greater than a second predetermined maximum exists between said first and second values.

15. The engine control system of claim 14 wherein:

said third algorithm is further structured to replace said first value with a repair value such that a mathematical discontinuity between said repair values and said second value is less than said mathematical discontinuity between said first and second values.

16. The engine control system of claim 13 wherein:

said mathematical comparison includes at least one from the group consisting of an absolute value of a difference between a first of said one or more corrected values and a first of said one or more neighboring values, an absolute value of a percent difference between said first of said one or more corrected values and said first of said one or more neighboring values, an absolute value of the difference between said first of said one or more corrected values and an arithmetic mean of said one or more neighboring values, and a standard deviation of said first of said one or more corrected values and said one or more neighboring values.

* * * * *